US006583553B2

(12) United States Patent
Sasaguri

(10) Patent No.: US 6,583,553 B2
(45) Date of Patent: Jun. 24, 2003

(54) ELECTRON EMITTING APPARATUS

(75) Inventor: Daisuke Sasaguri, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 165 days.

(21) Appl. No.: 09/730,388

(22) Filed: Dec. 6, 2000

(65) Prior Publication Data

US 2001/0020733 A1 Sep. 13, 2001

(30) Foreign Application Priority Data

Dec. 8, 1999 (JP) ..... 11-349420
Nov. 27, 2000 (JP) ..... 2000-359917

(51) Int. Cl.[7] ..... H01J 1/62

(52) U.S. Cl. ..... 313/495; 313/309; 315/169.1; 345/74

(58) Field of Search ..... 313/309, 310, 313/495, 496, 583; 315/169.1, 169.3; 345/74; 445/51, 36

(56) References Cited

U.S. PATENT DOCUMENTS

| | | | | | |
|---|---|---|---|---|---|
| 4,956,578 | A | * | 9/1990 | Shimizu et al. | 313/458 |
| 5,864,147 | A | | 1/1999 | Konuma | 257/10 |
| 5,866,988 | A | * | 2/1999 | Oda | 315/169.1 |
| 6,034,478 | A | * | 3/2000 | Kawade et al. | 315/169.1 |
| 6,114,804 | A | * | 9/2000 | Kawase et al. | 313/495 |
| 6,366,015 | B1 | * | 4/2002 | Shibata | 313/495 |
| 6,384,541 | B1 | * | 5/2002 | Ohnishi et al. | 315/169.3 |

FOREIGN PATENT DOCUMENTS

| | | | |
|---|---|---|---|
| EP | 0 660 357 A1 | 6/1995 | H01J/1/30 |
| EP | 0 701 265 A1 | 3/1996 | H01J/1/30 |
| EP | 0 716 439 A1 | 6/1996 | H01J/3/02 |

OTHER PUBLICATIONS

Okuda, M., et al., *Invited Paper: Electron Trajectory Analysis of Surface Conduction Electron Emitter Displays (SEDs)*, SID 98 Digest, pp. 185–188, 1998.

Japanese Journal of Applied Physics; Toshiaki Kusunoki et al.; "Fluctuation–Free Electron Emission from Non–Formed Metal–Insulator–Metal (MIM) Cathodes Fabricated by Low Current Anodic Oxidation" vol. 32 (1993), pp. 1695–1697, Part 2, No. 11B, Nov. 15, 1993.

Journal of Applied Physics; C.A. Mead; "Operation of Tunnel–Emission Devices"; vol. 32, No. 4, pp. 646–652, Apr., 1961.

Journal of Applied Physics; C.A. Spindt et al.; "Physical Properties of Thin–Film Field Emission Cathodes with Molybdenum Cones"; vol. 47, No. 12, pp. 5248–5263, Dec. 1976.

SID 98 Digest; M. Okuda et al.; Electron Trajectory Analysis of Surface Conduction Electron Emitter Displays (SEDs) 1998; pp. 185–188.

Advances in Electronics and Electron Physics; W.P. Dyke et al.; "Field Emission"; 1956,pp. 89–185.

* cited by examiner

*Primary Examiner*—Don Wong
*Assistant Examiner*—Jimmy T. Vu
(74) *Attorney, Agent, or Firm*—Fitzpatrick, Cella, Harper & Scinto

(57) ABSTRACT

An electron emitting apparatus that can realize a convergence of electron trajectories and an improved electron emission efficiency. The apparatus comprises a substrate having a first primary surface that is substantially planar, an electron emitting device comprising first and second electroconductive members disposed on the primary surface and at an interval from one another, and an anode electrode having a substantially planar surface opposite to the first primary surface. A voltage applying means of the apparatus applies a potential higher than a potential applied to the first electroconductive member to the second electroconductive member to irradiate electrons emitted from the electron emitting device onto the anode electrode.

14 Claims, 19 Drawing Sheets

ELECTRON EMITTING APPARATUS

BACKGROUND OF THE INVENTION

1. Field of the Invention

The present invention relates to an electron emitting apparatus.

2. Related Background Art

Up to now, as the electron emitting device, there have been roughly known two kinds of electron emitting devices consisting of a thermionic cathode and a cold cathode. The cold cathode are of the field emission type (hereinafter referred to as "FE type"), the metal/insulating layer/metal type (hereinafter referred to as "MIM type"), the surface conduction type electron-emitting device, and so on.

The examples of the FE type electron emitting devices have been known from "Field emission" of Advance in Electron Physics, 8,89 (1956) by W. P. Dyke & W. W. Dolan, "Physical properties of thin-film field emission cathodes with molybdenum cones" of J. Appl. Phys., 47,5248 (1976) by C. A. Spindt, U.S. Pat. No. 5,864,147, and so on.

The examples of the MIM type electron emitting devices have been known by "Operation of tunnel-emission devices" of J. Apply. Phys., 32,646 (1961) by C. A. Mead, and so on.

Also, the recent examples have been introduced by "Fluctuation-free electron emission from non-formed metal-insulator-metal (MIM) cathodes fabricated by low current anodic oxidation" of Jpn. J. Appl. Phys. vol. 32 (1993) pp. L1695, by Toshiaki Kusunoki, "An MIM-cathode array for cathode luminescent displays" of IDW '96 (1996) pp. 529 by Mutsumi Suzuki, et al, and so on.

The examples of the surface conduction type electron-emitting devices have been disclosed in EP-A-0660357, EP-A-0701265, "Electron trajectory analysis of surface conduction type electron emitter displays (SEDs)" of SID 98 DIGEST, pp. 185–188 by Okuda et al, EP-A-0716439, and so on. The surface conduction type electron-emitting devices are so designed as to utilize a phenomenon in which electrons are emitted by allowing a current to flow into a small-area thin film formed on a substrate in parallel with the film surface.

The above-mentioned surface conduction type electron emitting devices are of the planar type schematically shown in a plan view of FIG. 18A and a cross-sectional view of FIG. 18B, and of the vertical type schematically shown in cross-sectional views of FIGS. 19A and 19B. In FIGS. 18A, 18B, 19A and 19B, reference numeral 181 denotes a substrate, 182 and 184 are electrodes, 186 is an electroconductive film, 185 is a gap and 193 is a step forming member.

SUMMARY OF THE INVENTION

FIGS. 20 and 21 schematically show appearances in which the devices shown in FIGS. 18A, 18B, 19A and 19B are driven, respectively. In FIGS. 20 and 21, the same members as those in FIGS. 18A, 18B, 19A and 19B are designed by identical references.

In the conventional surface conduction type electron emitting device, electrons are tunneled from the electroconductive film 186 connected to the electrode 182 which is at a lower potential side to the electroconductive film 186 connected to the electrode 184 which is at a higher potential side. Then, the electrons thus tunneled reach an anode electrode 203 after the electrons are scattered on the higher-potential side electrode 184 and/or the higher-potential side electroconductive film 186 plural number of times. Parts of the tunneled electrons are taken into the higher-potential side electrode or the electroconductive film during the above scattering process, as a result of which sufficient electron emission efficiency cannot be ensured. In the present specification, the electron emitting efficiency is directed to a ratio of an emission current (Ie) that reaches the anode electrode 203 to a device current (If) that flows between the electrode 182 and the electrode 184 when the above device is driven.

In order to realize the image display device, electrons emitted from the electron emitting device are allowed to collide with the anode electrode having a phosphor to emit a light. However, in the image display device that requires a higher-precision image, it is necessary that the electron trajectories are converged, the electron emitting device is downsized, and the electron emission efficiency is improved. In general, as the characteristic of the electron emitting device, the electron emission efficient and the convergence of the electron trajectories have a relationship of trade-off, and it is difficult to satisfy the above conditions together.

The present invention has been made to solve the above problems, and therefore an object of the present invention is to provide an electron emitting apparatus that can realize the convergence of electron trajectories and an improvement of the electron emission efficiency together.

In order to achieve the above object, according to the present invention, there is provided an electron emitting apparatus, comprising:

(A) a substrate having a first primary surface which is substantially plane;

(B) an electron emitting device disposed on the first primary surface, comprising a first electroconductive member and a second electroconductive member which are disposed at an interval;

(C) an anode electrode having a substantially plane surface opposite to the first primary surface;

(D) voltage applying means for applying a potential higher than a potential applied to the first electroconductive member to the second electroconductive member in order to emit electrons from the electron emitting device; and (E) voltage applying means for applying a potential higher than the potential applied to the second electroconductive member in order to irradiate the electrons emitted from the electron emitting device onto the anode electrode;

wherein a through-hole (opening) that penetrates the second electroconductive member is defined in a part of the second electroconductive member which exists within a range from the gap to a distance Xs represented by the following expression (1), an electroconductive member to which a potential lower than said second electroconductive member is applied is disposed under said through-hole; and $$Xs=H\times Vf/(\pi\times Va) \quad (1)$$

where H is a distance between a plane of the anode electrode and the first primary surface, Vf is a voltage applied between the first electroconductive member and the second electroconductive member, Va is a voltage applied between the anode electrode and the first electroconductive member, and $\pi$ is the ratio of the circumference of a circle to its diameter.

DETAILED DESCRIPTION OF THE PREFERRED EMBODIMENTS

Now, a description will be given in more detail of preferred embodiments of the present invention with reference to the accompanying drawings. The dimensions, the material, the configuration and the relative arrangement of the structural parts described in the embodiments may be appropriately altered in accordance with the structure and various conditions of an apparatus to which the present invention is applied, and therefore the scope of the present invention is not limited to the embodiments described below.

Figure 1A:
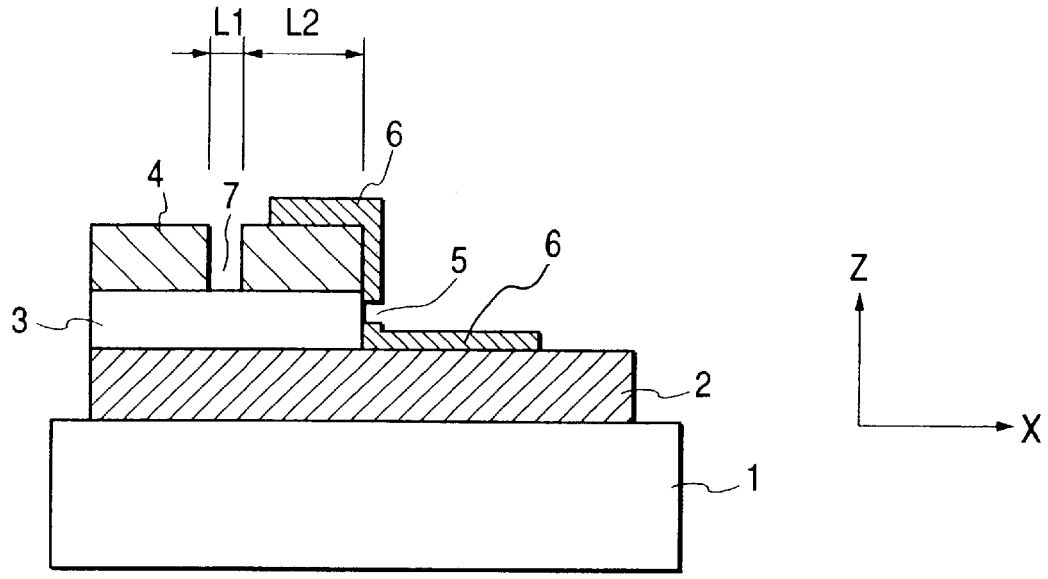
FIGS. 1A and 1B are diagrams showing an example of an electron emitting device according to the present invention.
Figure 1B:
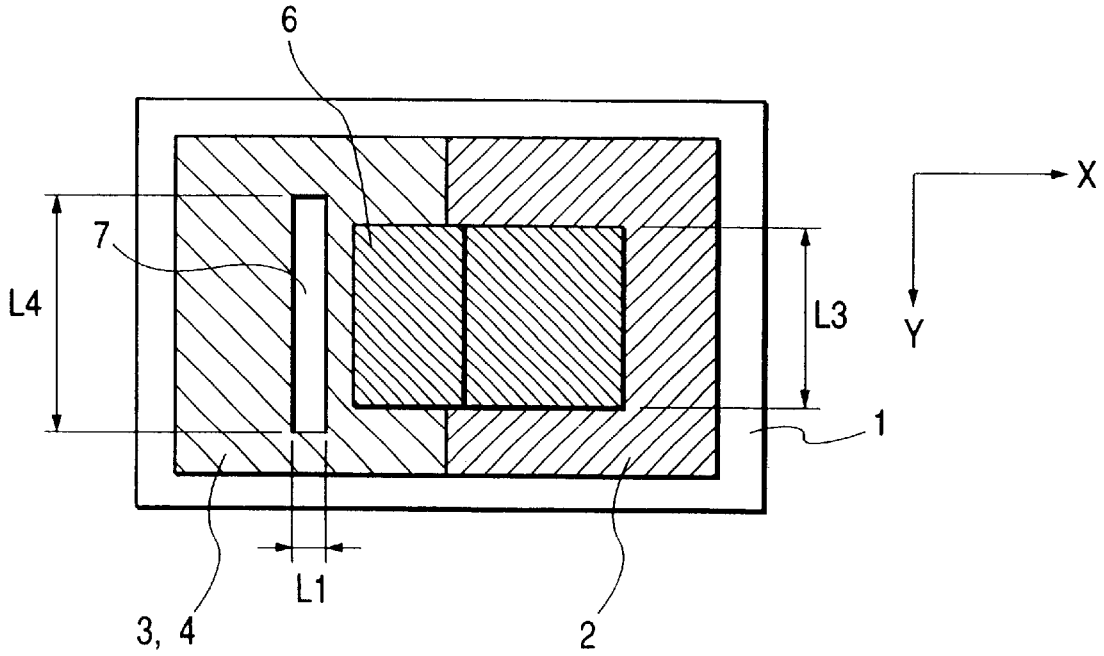
Figure 2:
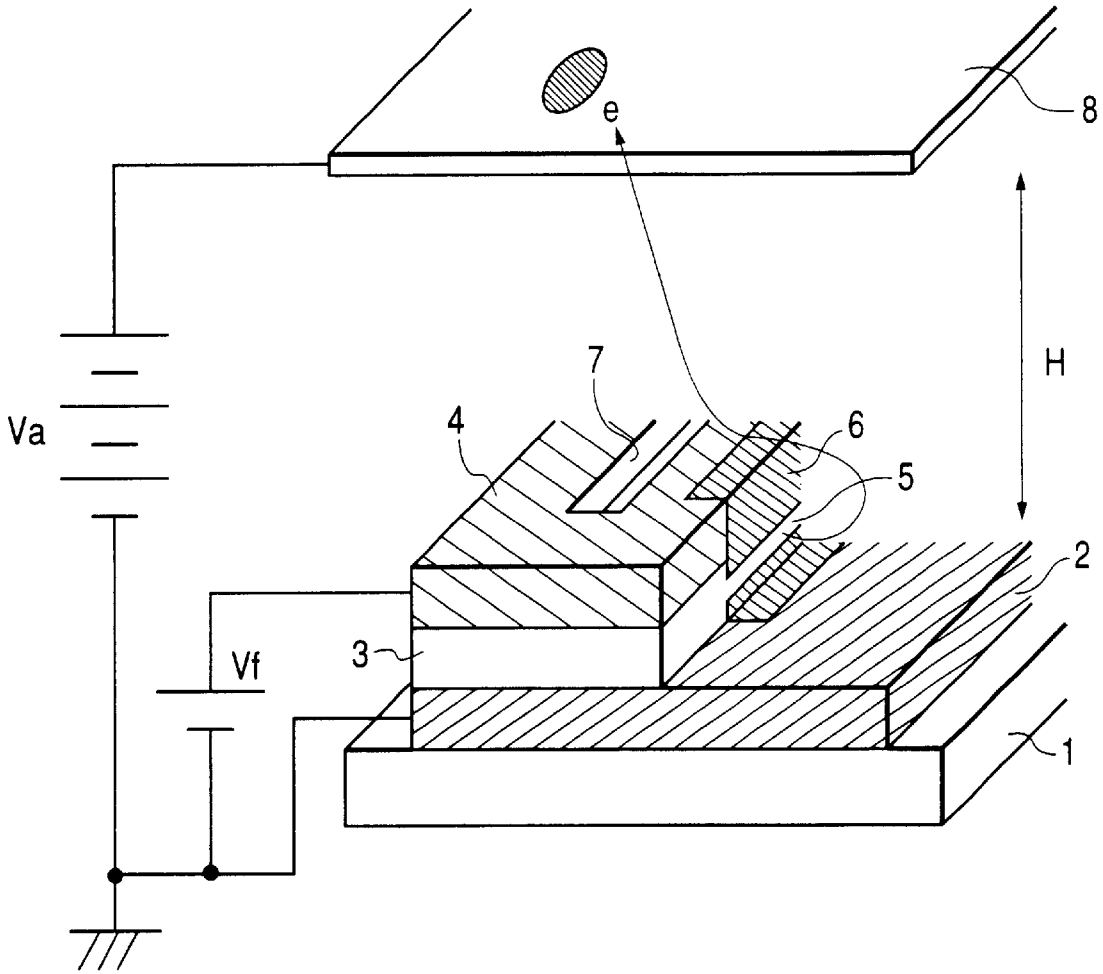
FIG. 2 is a diagram showing an actual driving state of the electron emitting device according to the present invention.

FIGS. 1A, 1B and 2 are schematic diagrams showing an example of a vertical type electron emitting device to which the present invention is preferably applied, FIGS. 3A to 3D and 4 are diagrams showing an example of a method of manufacturing the electron emitting device shown in FIGS. 1A and 1B and an example of driving the electron emitting device shown in FIGS. 1A and 1B. FIG. 1A is a schematically cross-sectional view of the vertical type electron emitting device and FIG. 1B is a schematically plan view thereof. FIG. 2 is a schematically perspective view of an electron emitting apparatus according to the present invention which comprises the device shown in FIGS. 1A and 1B in which an anode electrode 8 is disposed above the device.

In FIGS. 1A and 1B, 2 to 4, reference numeral 1 denotes a substrate, 2 is a lower-potential side electrode, 3 is an insulating layer, 4 is a higher-potential side electrode, 5 is a gap, 6 is an electroconductive film, and 7 is an opening (through-hole).

An example of a method of manufacturing the electron emitting device in accordance with the present invention will be described with reference to FIGS. 3A to 3D below.

(Process 1) An electrode 2 is laminated on a first primary surface of an insulating substrate a surface of which is satisfactorily cleaned or a substrate 1 such as a layered produce on which $SiO_2$ is laminated through a sputtering method or the like.

The electrode 2 is electrically conductive and formed through a general vacuum deposition technique such as a vapor evaporation method or a sputtering method, a photolithography technique or the like. The thickness of the electrode 2 is set to a range of from several tens nm to several mm, and preferably selected from a range of from several hundreds nm to several $\mu$m.

(Process 2) Subsequently, the insulating layer 3 is deposited on the electrode 2. The insulating layer 3 is formed through a general vacuum deposition method such as the sputtering method, a thermally oxidizing method, an anodizing method or the like. The thickness of the insulating layer 3 is set to a range of from 3 nm to 1 $\mu$m, and preferably selected from a range of from several tens nm to several hundreds nm.

Figure 3A:
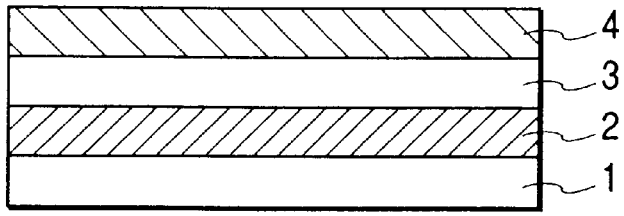
FIGS. 3A, 3B, 3C and 3D are diagrams showing an example of a method of manufacturing the electron emitting device according to the present invention.
Figure 3B:
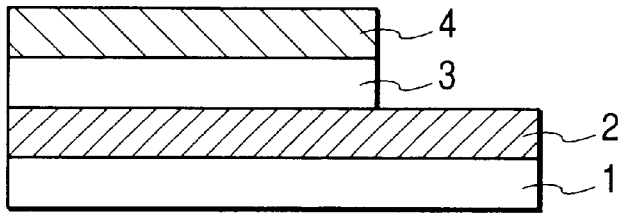

(Process 3) In addition, the electrode 4 is deposited on the insulating layer 3. Through the above processes, a layered product essentially consisting of the electrode 2, the insulating layer 3 and the electrode 4 is formed on the substrate 1 (FIG. 3A). The laminating direction of the layered product is substantially perpendicular to the first primary surface of the substrate 1. The electrode 4 is electrically conductive as in the electrode 2 and formed through a general vacuum deposition technique such as a vapor evaporation method or the sputtering method, a photolithography technique or the like.

The thickness of the electrode 4 is set to a range of from several nm to several hundreds nm, and preferably selected from a range of about several tens nm.

(Process 4) Subsequently, parts of the insulating layer 3 and the electrode 4 are removed through the photolithography technique, and a step structure formed by the insulating layer 3 and the electrode 4 is defined on the electrode 2 (FIG.

3B). This etching process may stop on the electrode 2 or may stop after a part of the electrode 2 has been etched.

During the operation of driving the device thus structured, the electrode 2 is set to a lower potential whereas the electrode 4 is set to a higher potential.

Figure 3C:
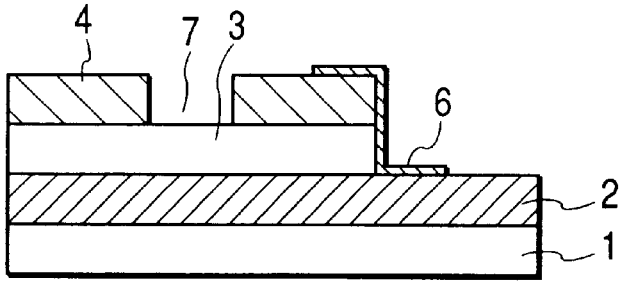

(Process 5) Subsequently, an area 7 (a through-hole (opening) that penetrates the electrode 4) where a part of the electrode 4 is removed from the substrate 1 through the photolithography technique is formed. (FIG. 3C). In this etching process, the process may stop on the insulating layer 3, a part of the insulating layer 3 may be removed, or the process may stop on the device electrode 2. As a result, the electrode 4 has the opening portion (through-hole) 7 that penetrates in the laminating direction of the electrode 2, the insulating layer 3 and the electrode 4.

The area (through-hole) 7 removed in this process is formed in the vicinity of the step formed by the electrode 4 and the insulating layer 3. The optimum distance and configuration of the area 7 may be appropriately selected in accordance with a size of "a higher potential side electroconductive member" which will be described later. The size L1 in the through-hole 7 is selected from a range of several tens nm to several $\mu$m. The details of the size of the area 7 will be described later.

(Process 6) Then, the electroconductive film 6 is so formed as to connect between the electrode 2 and the electrode 4 (FIG. 3C).

A length L3 of an area on which the electroconductive film 6 is deposited (refer to FIG. 1B) is appropriately set in accordance with an electron emission length, the device structure, the arrangement of the device and so on. However, the length L3 is selected from a range shorter than a length L4 of an area 7 from which the above higher-potential side electrode 4 is removed.

The electroconductive film 6 may be made of metal such as Pd, Ru, Ag, Au, Ti, In, Cu, Cr, Fe, Zn, Sn, Ta, W or Pd, an alloy containing two or more of those materials, oxide such as PdO, $SnO_2$, $In_2O_3$, PbO or $Sb_2O_3$, boride such as $HfB_2$, $ZrB_2$, $LaB_6$, $CeB_6$, $YB_4$, or $GdB_4$, carbide such as TiC, ZrC, HfC, TaC, SiC or WC, nitride such as TiN, ZrN or HfN, semiconductor such as Si or Ge, carbon, AgMg, NiCu, Pb, Sn or the like. Also, the resistance of the electroconductive film 6 is preferably set to a sheet resistance of $10^3$ to $10^7$ Ω/square from the "forming" viewpoint which will be described later.

Figure 3D:
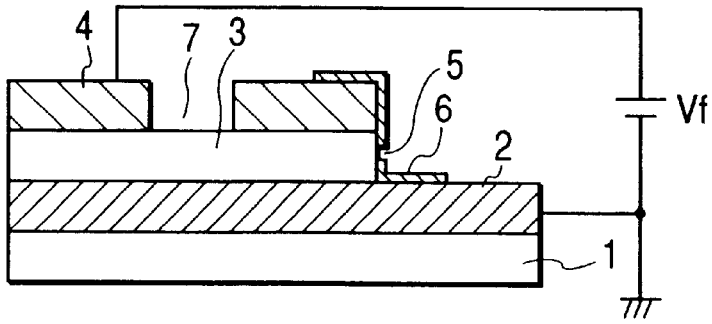

(Process 7) Then, a current is allowed to flow in the electroconductive film 6, and the gap 5 is defined in a part of the electroconductive film 6 to form the electron emitting device (FIG. 3D). A process of forming the gap 5 by allowing the current to flow in the electroconductive film 6 in this way is called "forming". The electroconductive film 6 is substantially divided into two films through the "forming" process.

In the electron emitting device according to the present invention, there is a case in which the electroconductive film 6 is omitted. In this case, the above gap 5 is formed by an interval between the. electrode 2 and the electrode 4 (the thickness of the insulating layer 3). In this case, the above process 6 and subsequent processes can be omitted.

For that reason, in the present invention, the electrode 2 and the electroconductive film 6 connected to the electrode 2 may be called "lower-potential side electroconductive member" together. Similarly, in the present invention, the electrode 4 and the electroconductive film 6 connected to the electrode 4 may be called "higher-potential side electroconductive member" together.

In addition, in the electron emitting device according to the present invention, there is a case in which a process 8 called "activation" is further conducted after the gap 5 has been formed. This process is, for example, a process of forming a carbon film on an insulating layer 3 within the gap 5 as well as the electroconductive film 6 in the vicinity of the gap 5 by applying a voltage to the electrode 2 and the electrode 4 under the condition where carbon compound exists. A narrower gap is formed in the gap 5 formed by the forming process, etc., by conducting the above process. This activation operation may be increase the electron emission amount.

The carbon film formed through the activation operation is connected to "lower-potential side electroconductive member" and/or "higher-potential side electroconductive member" with the narrower gap (second gap) formed within the gap 5 as a boundary, which depends on a potential applied to the electrodes 2 and 4 during the activation operation.

For that reason, in the present invention, even if the activation operation is conducted, there is a case in which the carbon film connected to the "lower-potential side electroconductive member" and the "lower-potential side electroconductive member" are called "lower-potential side electroconductive member" together. Similarly, in the present invention, even if the activation operation is conducted, the carbon film connected to the "higher-potential side electroconductive member" and the "higher-potential side electroconductive member" are called "higher-potential side electroconductive member" together.

The carbon film produced in the activation operation is, for example, a film that mainly contains graphite (which contains so-called HOPG, PG, GC. HOPG is directed to the substantially complete crystal structure of graphite, PG is directed to the slightly disordered crystal structure of crystal grains about 200 Å, and GC is directed to the largely disordered crystal structure of crystal grains about 20 Å) and/or amorphous carbon (which is directed to amorphous carbon and the mixture of amorphous carbon and the microcrystal of the above graphite).

Figure 4:
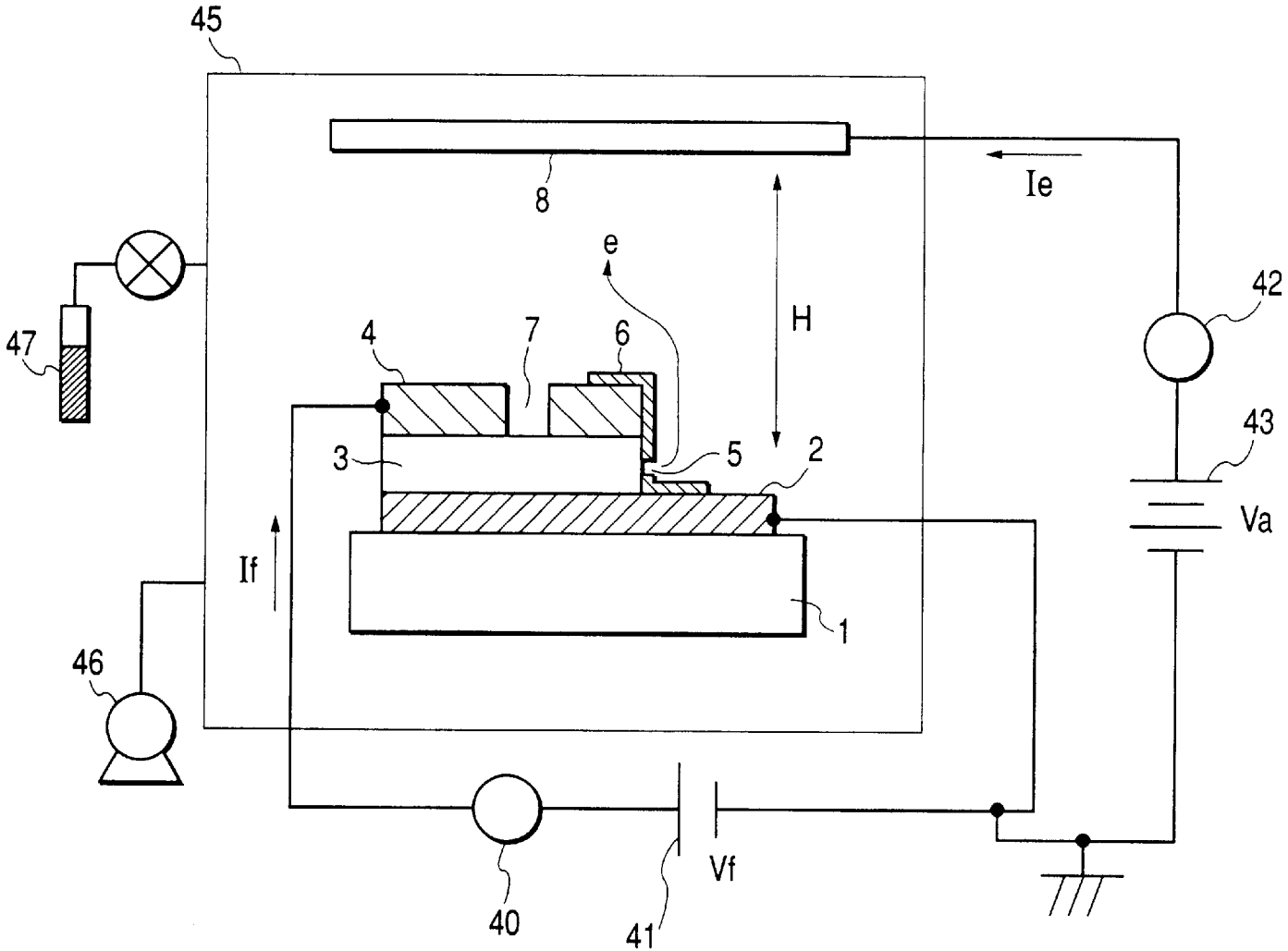
FIG. 4 is a diagram showing an example of a method of manufacturing the electron emitting device according to the present invention.

An example of a vacuum processing apparatus used in the above "forming" process and "activation" operation will be described with reference to FIG. 4. Also, the apparatus shown in FIG. 4 can be used as an apparatus for measuring the characteristics of the electron emitting device as it is. In FIG. 4, reference numeral 45 denotes a vacuum chamber, and 46 is an exhaust pump. Reference numeral 47 denotes a supply source of carbon compound gas used in the activation operation. The device of the present invention is disposed within the vacuum chamber 45.

That is, reference numeral 1 denotes a substrate, 2 is a lower-potential side electrode, 3 is an insulating layer, 4 is a higher-potential side electrode to which a potential higher than the electrode 2 is applied, 5 is a gap, 6 is an electroconductive film, 41 is a power supply for applying a voltage Vf between the electrode 2 and the electrode 4. Also, reference numeral 40 denotes an ammeter for measuring a device current If that flows between the lower-potential side electrode 2 and the higher-potential electrode 4, 8 is an anode electrode for complementing an emission current Ie emitted from the device. Further, reference numeral 43 denotes a voltage source for applying a potential higher than a potential applied to the electrode 4 to the anode electrode 8, and 42 is an ammeter for measuring the emission current Ie emitted from the electron emitting device.

As an example, measurement can be made assuming that a voltage across the anode electrode is set to a range of 0 to 10 kV, and a distance H between the anode electrode and the electron emitting device is set to a range of 100 $\mu$m to 8 mm. In this case, the voltage across of the anode electrode is a voltage value between a potential applied to the lower-potential side electrode 2 and a potential applied to the anode electrode. Also, the above distance H is indicated by a distance between the gap 5 and the anode electrode in a narrow sense. However, since the thickness of the layered product essentially consisting of the electrode 2, the insulating layer 3 and the electrode 4 is very thin, the distance H is defined as a distance between the anode electrode and the substrate 1 without any problem.

An apparatus necessary for measuring under the vacuum atmosphere such as a vacuum gauge not shown is disposed within the vacuum chamber 45 so as to conduct measurement evaluation under a desired vacuum atmosphere. The exhaust pump 46 is made up of a normal high vacuum device system formed of a turbo pump and a rotary pump and a super high vacuum device system formed of an ion pump or the like.

The above activation operation can be conducted, for example, as follows:

That is, after the substrate 1 is disposed within the vacuum chamber 45, and a gas is exhausted from the vacuum chamber 45 into a vacuum atmosphere, carbon compound gas is introduced into the vacuum chamber 45 by the supply source 47 of carbon compound gas. Then, a voltage is applied between the higher-potential side electrode 4 and the lower-potential side electrode 2 under the atmosphere containing carbon compound gas. It is preferable that the voltage waveform is of a pulse waveform, and the voltage is repeatedly applied. To achieve this manner, there are a method of continuously applying pulses with pulse peak values as a constant voltage, and a method of applying voltage pulses while the pulse peak value increases.

Figure 18A:
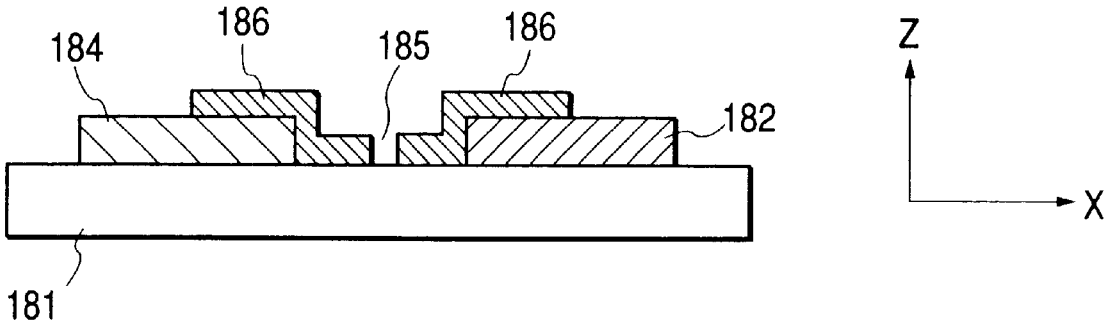
FIGS. 18A and 18B are diagrams showing a conventional planar type electron emitting device.
Figure 18B:
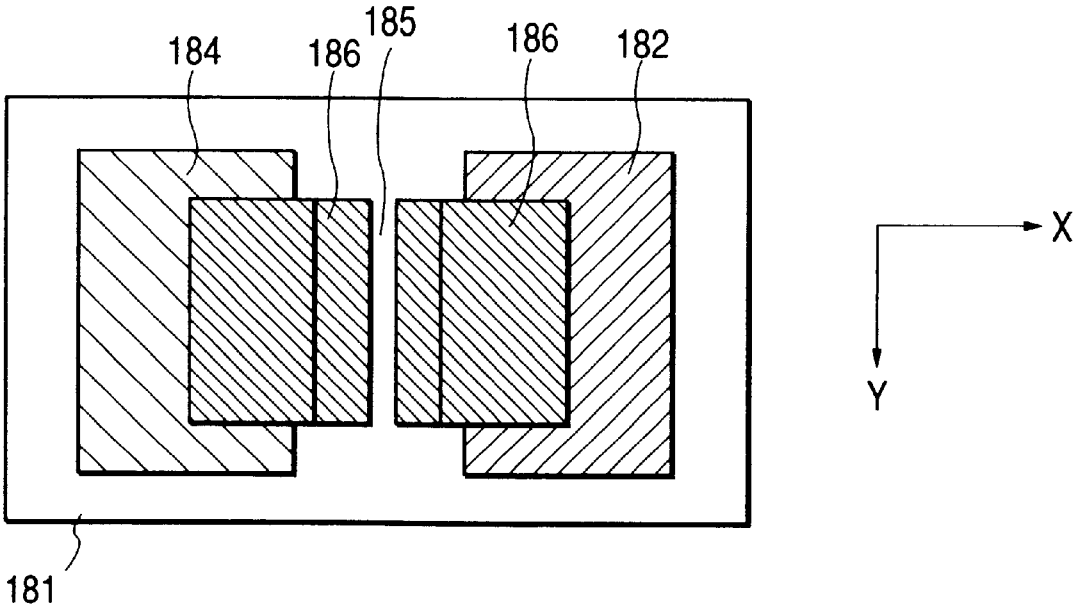
Figure 19A:
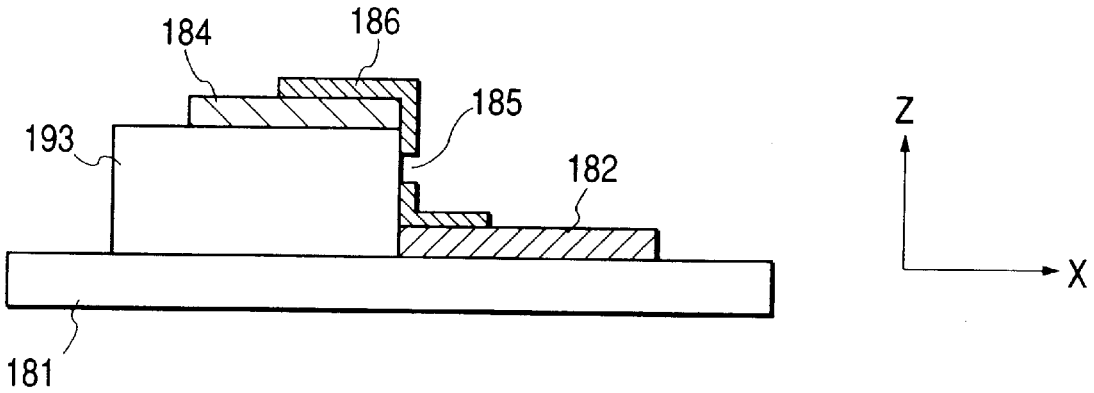
FIGS. 19A and 19B are diagrams showing a conventional vertical type electron emitting device.
Figure 19B:
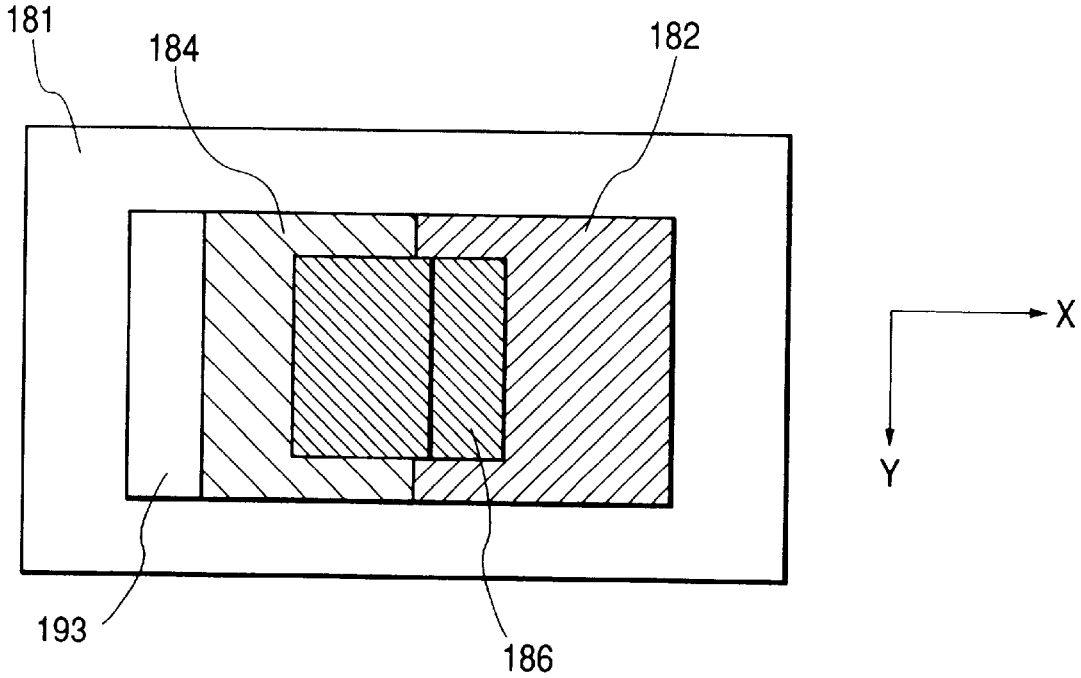
Figure 20:
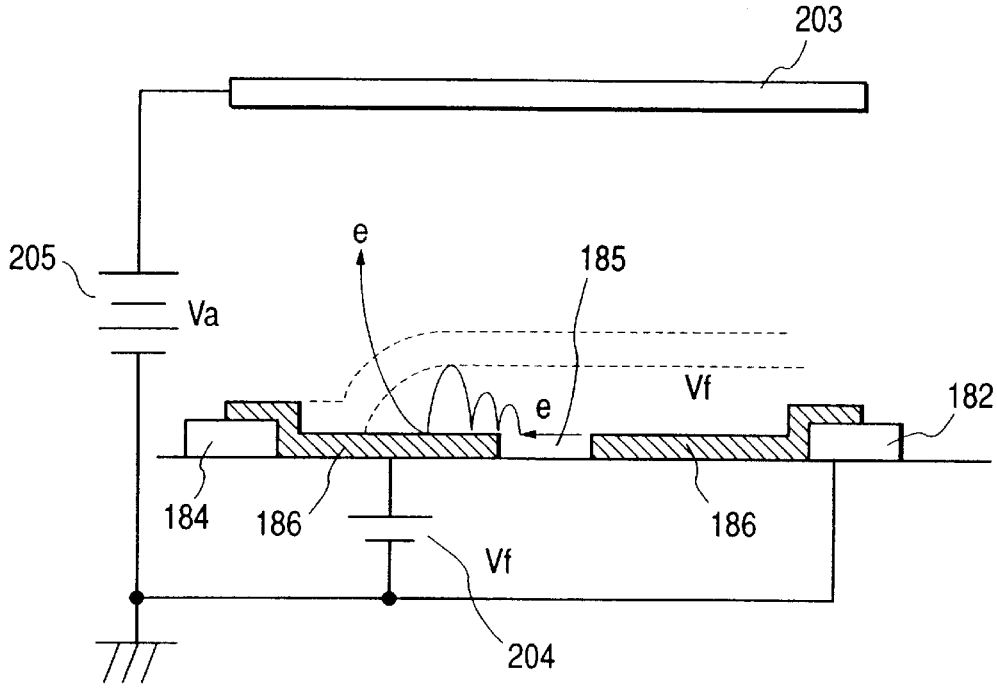
FIG. 20 is a diagram showing the field distribution and the trajectory of electrons in the conventional planar type electron emitting device.

Subsequently, the electron emission characteristic of the electron emitting device according to the present invention as shown in FIGS. 1A, 1B and 2 will be described in more detail. First, the conventional surface conduction type electron emitting device will be described. FIGS. 18A and 18B show the structure of a conventional planar type device whereas FIGS. 19A and 19B show the structure of a conventional vertical type device.

Figure 22:
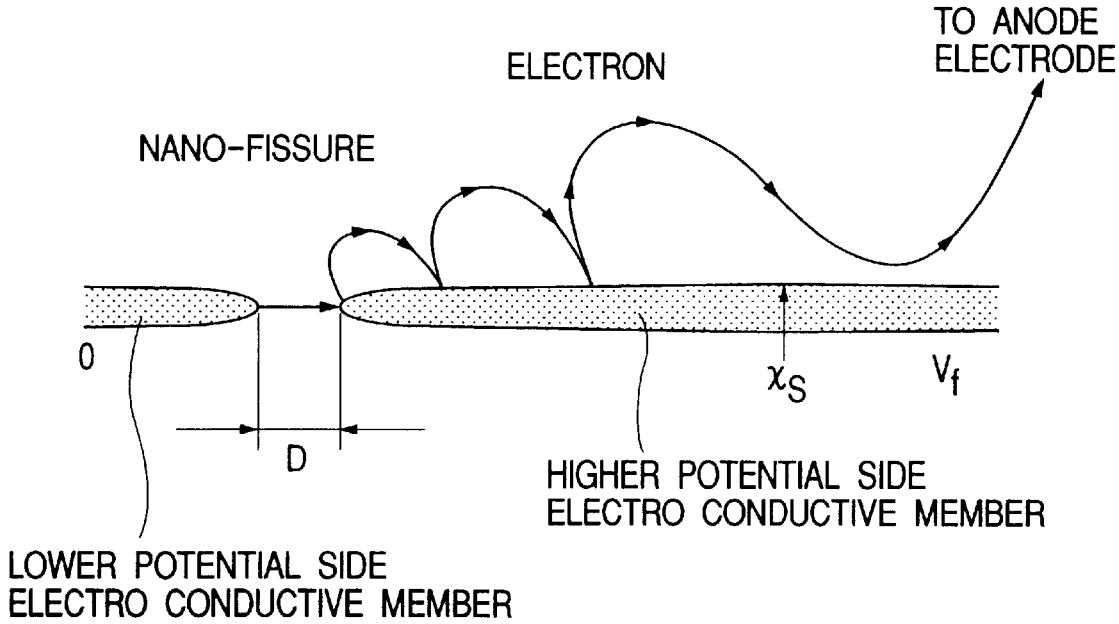
FIG. 22 is a schematic diagram showing the simulation results of electron emission from a surface conduction electron emitting device.

Now, the electron emission mechanism of the surface conduction type electron emitting device will be described with reference to the device shown in FIGS. 18A and 18B as an example. The surface conduction type electron emitting device has an electroconductive film 186 having a gap 185 of nm order, and it is presumed that when a drive voltage Vf is applied to the electroconductive film 186, electrons tunnel the gap, and parts of electrons are scattered on the "higher-potential side electroconductive member" described above as shown in FIG. 22.

Parts of electrons that have tunneled the gap 185 repeats elastic scattering (multiple scattering) on the "higher-potential side electroconductive member" plural number of times. Then, it is presumed that only the electrons that exceed the following feature distance Xs reach the anode electrode disposed above the device.

The above feature distance Xs is represented by the following expression (1):

$$Xs=(D/2)\sqrt{[1+\{(2H\times Vf)/(\pi\times Va\times D)\}^2]}\cong(H\times Vf)/(\pi\times Va) \quad (1)$$

where H is a distance between the electron emitting device and the anode electrode, $\pi$ is the ratio of the circumference of a circle to its diameter, D is the width of the gap 5, Vf is a drive voltage, and Va is a voltage across the anode electrode. In this situation, the voltage across the anode electrode is directed to a voltage value between the potential applied to the lower-potential side electrode 2 and the potential applied to the anode electrode. Also, the above distance H is indicated by a distance between the gap 5 and the anode electrode in a narrow sense. However, since the thickness of the layered product essentially consisting of the electrode 2, the insulating layer 3 and the electrode 4 is very thin, so the distance H can be defined as a distance between the anode electrode and the substrate 1 without any problem.

The second approximation of the above expression (1) is accomplished in case of $Vf/d\cong Va/H$ (this is sufficiently accomplished in case of the normal surface conduction type electron emitting device).

For example, in the case where the drive voltage Vf is 20 V, the anode voltage Va is 10 kV, H is 2 mm and $\pi$ is 3.14, the above Xs becomes about 1 $\mu$m.

The electron emission efficiency is controlled by a reduction in the number of electrons which is partially absorbed by the "higher-potential side electroconductive member" during the multiple scattering process until the emitted electrons exceed the above Xs. Although the ratio of scattered electrons (scattering coefficient) $\beta$ with collision of electrons of about several tens eV is not known, it is estimated that the ratio is about 0.1 to 0.5 per one scattering.

Because $\beta$ is 1 or less in the above scattering mechanism, it is presumed that the amount of electrons extracted into vacuum (existence probability) is reduced by exponent in accordance with an increase in the number of times of scattering.

Therefore, in the conventional surface conduction type electron emitting device shown in FIGS. 18A, 18B, 19A and 19B, it is presumed that the electrons that have tunneled the gap 185 are scattered on the "higher-potential side electroconductive member" within the Xs at least once, and many electrons are scattered plural number of times. For that reason, because the electrons taken in the "higher-potential side electroconductive member" become the device current If, it is presumed that the electron emission efficiency is deteriorated as the number of times of scattering is larger.

Also, the electron beam diameter formed on the anode electrode by the electrons emitted from the device can be described as follows:

$$Lh\cong 4\ Kh\times H\sqrt{(Vf/Va)}$$

$$Lw\cong 2\ Kw\times H\sqrt{(Vf/Va)}$$

where Lh is a size of the beam along a longitudinal direction of the beam, that is, a direction corresponding to a direction perpendicular to a direction along which the lower-potential side electrode of the surface conduction type electron emitting device faces the higher-potential side electrode thereof (Y-direction in FIGS. 18A, 18B, 19A and 19B). Also, Lw shows a size of the beam along a lateral direction of the beam, that is, a direction along which the lower-potential side electrode of the surface conduction type electron emitting device faces the higher-potential side electrode thereof (X-direction in FIGS. 18A, 18B, 19A and 19B). Also, Kh and Kw can approximate to about 1 although they may be slightly different depending on the device structure.

It is understood from the above-mentioned reasons that the electron emission efficiency can be enhanced by suppressing the scattering of the emission electrons.

Under the above circumstances, the electron emitting device according to the present invention can improve the electron emission efficiency and reduce the electron beam diameter as will be described later since the lower-potential electroconductive member 2 is disposed under the through-hole (opening) which is formed in a part of the "higher-potential side electroconductive member" existing within a range of from the gap 5 to the feature distance Xs represented by the above expression (1) and penetrates the "higher-potential side electroconductive member", as shown in FIGS. 1A, 1B, 16A and 16B.

In the present specification, "the higher-potential side electroconductive member existing within a range of from the gap 5 to the feature distance Xs" means the "higher-potential side electroconductive member" situated inside the respective spheres when those spheres each having a radius Xs are continuously formed in the longitudinal direction of the gap (Y-direction in FIGS. 1B and 16B) with the gap as a center in a broad sense.

Since the width of the gap 5 (a length in the Z-direction in FIG. 1A) is about several nm to ten several nm, it can be substantially ignored as compared with the length of the feature distance Xs. Also, since the electroconductive film 6 and the higher-potential electrode 4 in the vertical type electron emitting device shown in FIGS. 1A and 1B are very small values as compared with the length of the feature distance Xs, there is substantially no problem that the above feature distance is defined by the spheres each having the radius Xs as described above.

Also, "the higher-potential side electroconductive member existing within a range of from the gap 5 to the feature distance Xs" is directed to the "higher-potential side electroconductive member" within a range of from the gap 5 to a position apart from the gap 5 by the above feature distance Xs along the surface of the "higher-potential side electroconductive member".

Further, "a range of from the gap to the distance Xs" is directed to a range on a line segment extending from the gap toward the second electroconductive member along the surface of the second electroconductive member by the above feature distance Xs.

Still further, "a line segment extending along the surface of the second electroconductive member by the above feature distance Xs" can be directed to a line segment extending from the gap toward the second electroconductive member in a direction along which the first electroconductive member and the second electroconductive member face each other (the widthwise direction of the gap 5).

Yet still further, "a line segment extending along the surface of the second electroconductive member by the above feature distance Xs" is substantially a straight line when the electron emitting device is viewed from the anode electrode.

Figure 5:
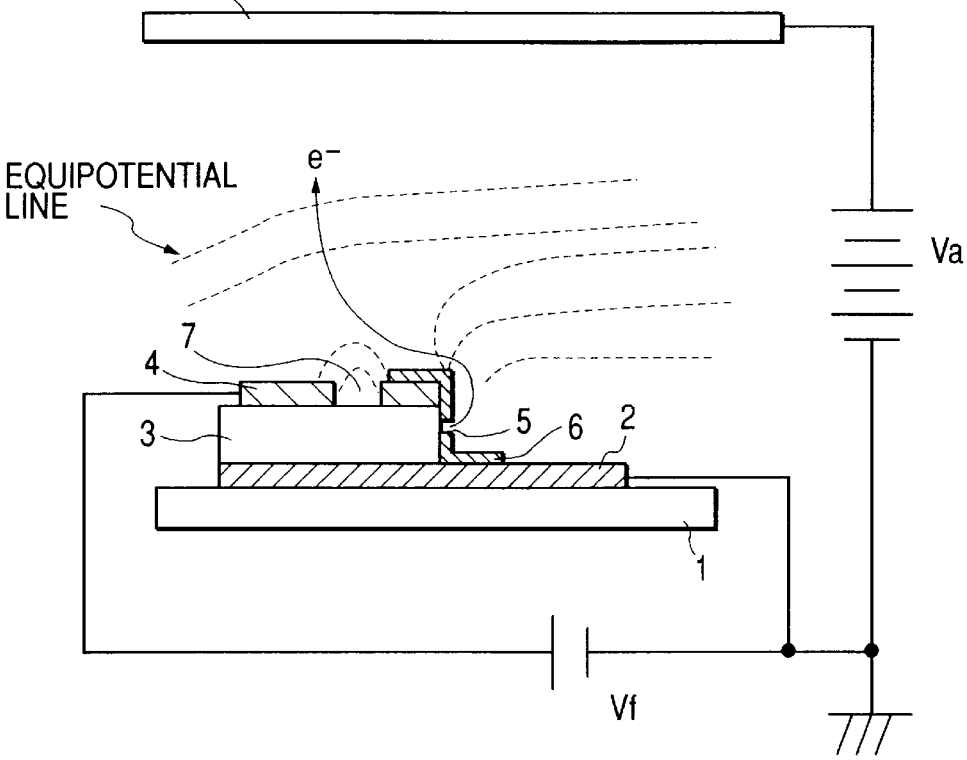
FIG. 5 is a diagram for explanation of a potential distribution and an electron beam in the driving state of the electron emitting device according to the present invention.

The electron emitting device thus structured according to the present invention reduces the number of times of scattering of electrons on the "higher-potential side electroconductive member" and realizes the high efficiency by utilizing such a phenomenon that the potential from the lower-potential side electrode 2 is exuded onto an area (through-hole) 7 where the higher-potential side electrode (higher-potential side electroconductive member) does not exist as shown in FIG. 5.

Hereinafter, the feature of the electron emission according to the present invention will be described in detail with reference to the above-mentioned electron emitting mechanism.

Figure 21:
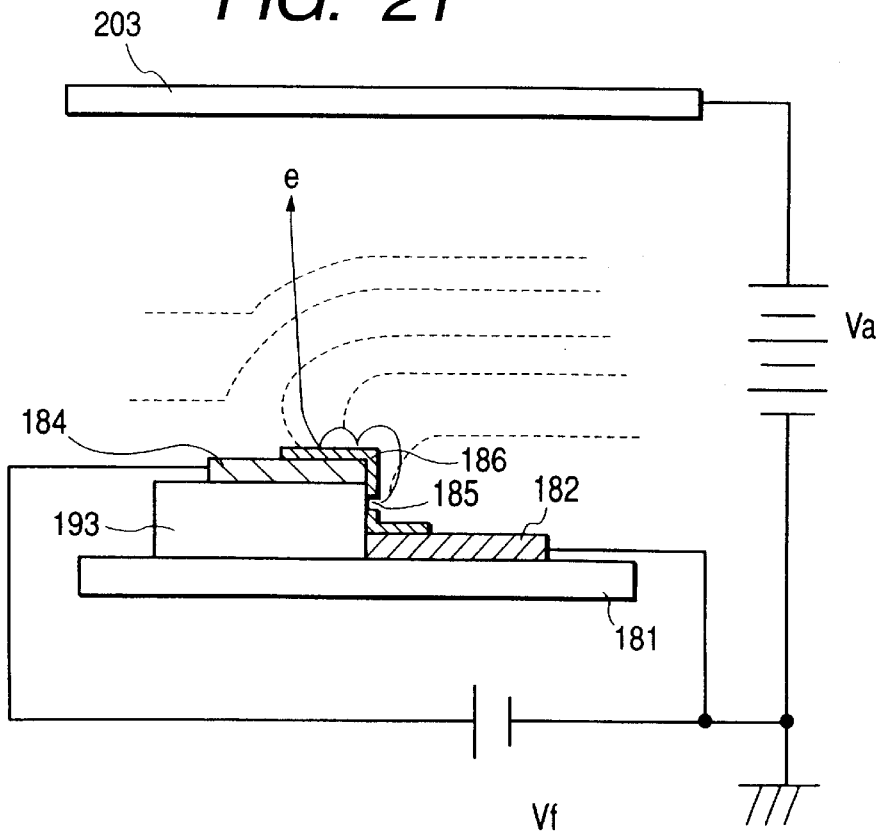
FIG. 21 is a diagram showing the field distribution and the frajectory of electrons in the conventional vertical type electron emitting device.

First, the action of the electrons in the conventional vertical type electron emitting device will be described with reference to FIG. 21. After the electrons that have tunneled the gap 185 are multiple-scattered on the surface of the "higher-potential side electroconductive member" (a surface perpendicular to the anode electrode plane) once or plural number of times, parts of electrons fly out upward of the higher-potential electrode 184. Many electrons among those electrons are again scattered on a surface of the "higher-potential side electroconductive member" which is substantially in parallel with the plane of the anode electrode, and parts of the electrons reach the anode electrode 203 above the device.

On the other hand, in case of the electron emitting device (electron emitting apparatus) according to the present invention as shown in FIG. 5, the potential is exuded from the lower-potential side electrode 2 toward the area (through-hole) 7 from which a part of the higher-potential side electrode 4 ("higher-potential side electroconductive member") are penetratedly removed. The electrons are influenced by that exudation so as to be suppressed from reaching (scattering) a surface of the "higher-potential side electroconductive member" which is substantially in parallel with the anode electrode plane. As a result, the amount of electrons that reach the anode electrode 8 disposed above the device increases. For that reason, the electron emission efficiency of the electron emitting device (electron emitting apparatus) according to the present invention is improved as compared with the structure shown in FIG. 21.

Further, when the position of the gap 5 is suppressed at a position closer to the higher-potential side electrode 4 in addition to the above structure, the number of times of electrons on a side wall (a face substantially perpendicular to the anode electrode plane) can be reduced.

In the present invention, since the opening area (through-hole) 7 of the higher-potential side electrode 4 ("higher-potential side electroconductive member") is disposed within the range of from the gap 5 to the feature distance Xs, the maximum effect is obtained so that the higher efficiency can be made.

Also, in order to improve the electron emitting efficiency according to the present invention, it is necessary that the lower-potential side electrode 2 exists below the opening area 7 in addition to the provision of the opening area (through-hole) 7 that penetrates the higher-potential side electrode 4 ("higher-potential side electroconductive member").

Subsequently, the optimum size of the width L1 of the area 7 in the electron emitting device according to the present invention will be described.

In order to suppress the scattering of electrons on a face of the "higher-potential side electroconductive member" which is substantially in parallel with the anode electrode plane, the above area 7 is formed. However, if L1 has a sufficient size, the improvement effect of the electron emission characteristic is eliminated.

Figure 6:
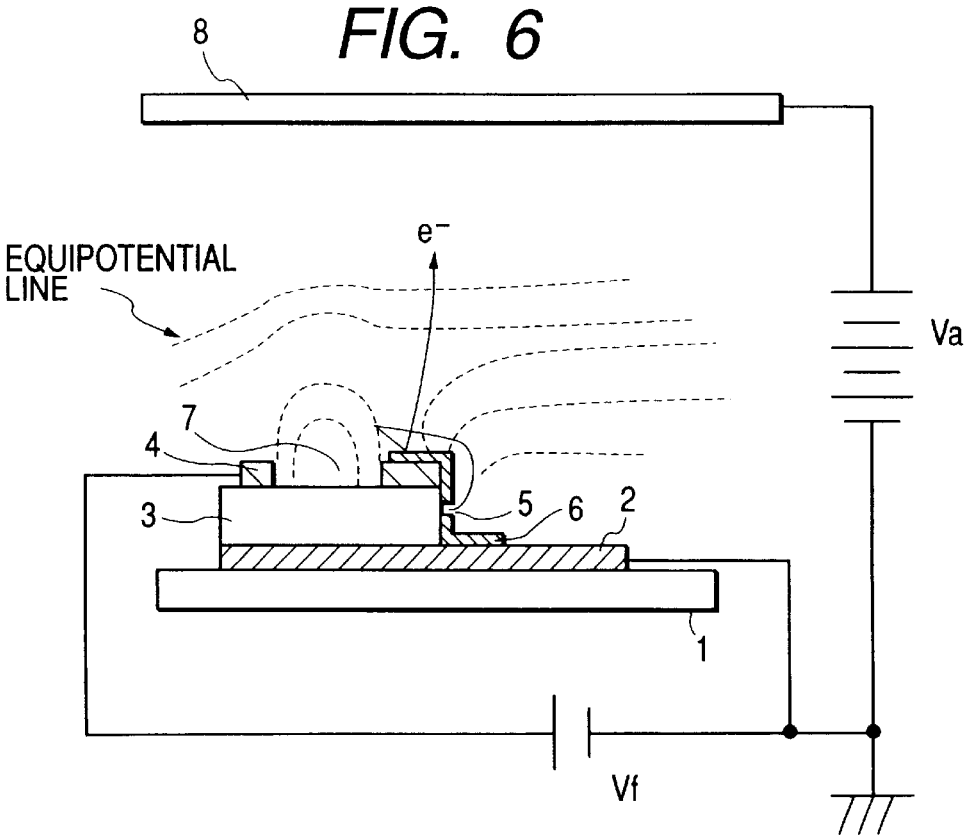
FIG. 6 is a diagram showing an equipotential surface and the trajectory of electrons when a width L1 of an area from which a higher potential electrode of the electron emitting device according to the present invention is removed is long.

In the present specification, "L1 has a sufficient size" means the dimension of L1 by which such an electric field that the electrons emitted from the gap 5 receive a force in a minus direction with respect to the Z-axial direction is exuded from the area 7 as shown in FIG. 6.

In this case, the electrons that fly out upward of the face of the "higher-potential side electroconductive member" which is substantially in parallel with the anode electrode plane are pushed back by an influence of the potential formed on the area 7 and drop down on the "higher-potential side electroconductive member", to thereby increase the number of times of scattering. For that reason, the electron emission efficiency starts to be deteriorated.

Figure 7:
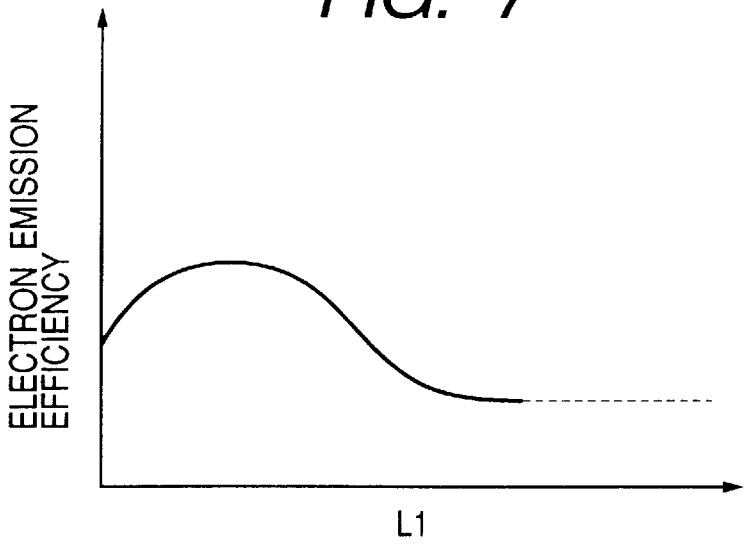
FIG. 7 is a diagram showing a relationship between the electron emission efficiency of the electron emitting device according to the present invention and L1.

FIG. 7 shows the dependency of the area (through-hole) 7 of the electron emission efficiency on the width L1 in the X-direction. The optimum size of L1 is determined by the minimum dimension determined by the machining technique, the feature distance Xs and so on, and is preferably selected from a range of from 50 nm to 10 $\mu$m.

Figure 8:
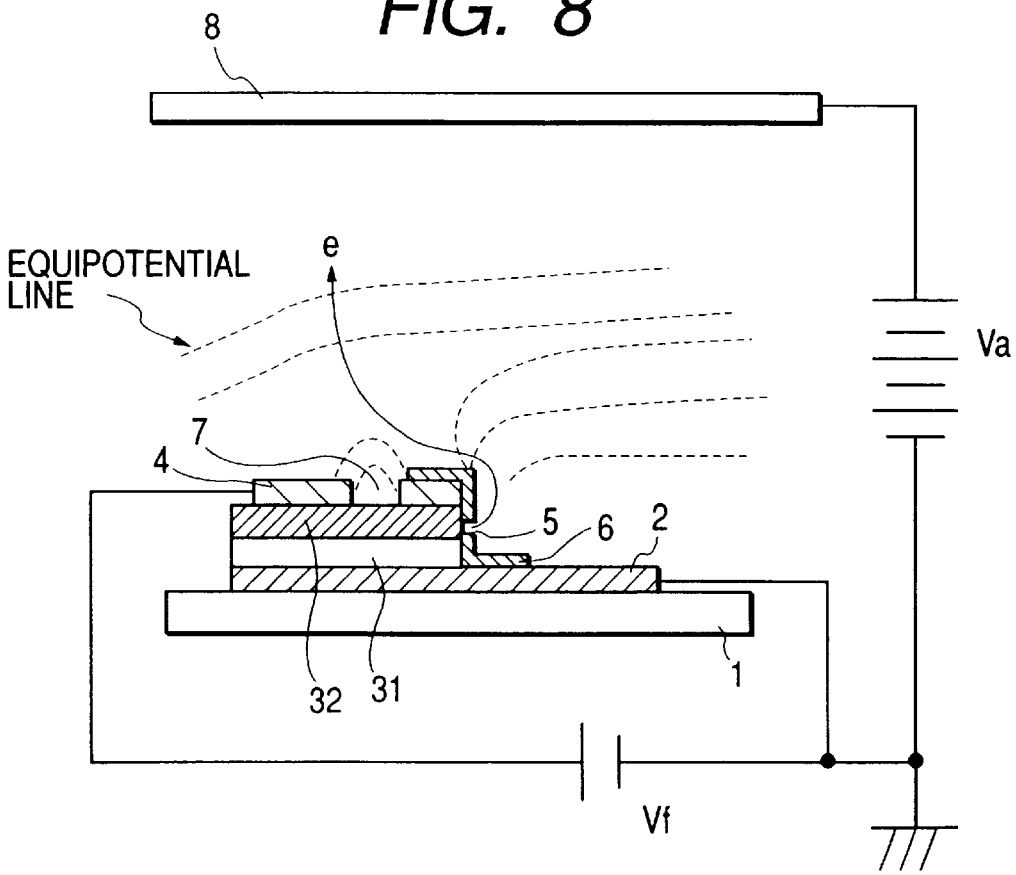
FIG. 8 is a diagram showing the electron emitting device having two insulating layers according to the present invention.

Also, the magnitude of the potential exuded from the area 7 can be controlled by laminating at Least two kinds of layers made of material different in dielectric constant as the insulating layer 3. For example, as shown in FIG. 8, if an insulating layer 31 lower in dielectric constant is formed on the lower-potential electrode 2 side and an insulating layer 32 higher in dielectric constant is formed on the higher-potential electrode 4 side, thereby being capable of reducing the exudation of the potential.

The above effect can increase the exudation of the potential in the case where the material of the higher-dielectric constant and the material of the lower-dielectric constant are turned upside down. Those order may be appropriately selected in accordance with the drive voltage and the electrode size. Those effects utilize a phenomenon that an electric field is concentrated to the material lower in dielectric constant in the case where a voltage is applied to the material higher in dielectric constant and the material lower in dielectric constant and can be made by the combination of various insulating materials different in dielectric constant.

In addition, the height of the exudation of the potential from the area 7 can be controlled by the etching depth of the insulating layer 3 in a process of removing the higher-potential electrode 4 ("higher-potential side electroconductive member"). When the insulating layer 3 is removed to a certain depth, the material lower in the dielectric constant is formed in the area. For that reason, the exudation of the potential can be controlled from the same effect as that in the above case where the materials different in dielectric constant are laminated on each other.

In the electron emitting device (electron emitting apparatus) according to the present invention, the configuration of the area from which the higher-potential electrode ("higher-potential side electroconductive member") is removed can be appropriately selected in accordance with the design of the device and the device manufacturing method. For example, one or plural circular openings may be formed, or plural slit-like openings may be formed. The design of those configurations is selected so as to obtain the exudation of the potential from the lower-potential side electrode 2, and arbitrary configurations may be selected.

Preferred drive conditions in the electron emitting device (electron emitting apparatus) of the type shown in FIGS. 1A and 1B according to the present invention will be described. An example shown in FIG. 5 is the equipotential line and the electron trajectory provided that a distance H between the electron emitting device and the anode electrode 8 (a distance between the substrate 1 and anode electrode 8) is 2 mm, a voltage Va applied between the anode electrode 8 and the lower-potential side electrode 2 is 10 kV, and a voltage Vf applied between the higher-potential side electrode 4 and the lower-potential side electrode 2 is 15 V. In the case where the electron scattering phenomenon is taken into consideration in the electron emitting device (electron emitting apparatus) according to the present invention, if Vf is 30 V or less, Va and H are not particularly restricted but are selected from an area that can retain the vacuum withstand voltage, and its range is from one hundred V to 20 kV.

Subsequently, another structural example of the electron emitting device according to the present invention will be described.

Figure 9:
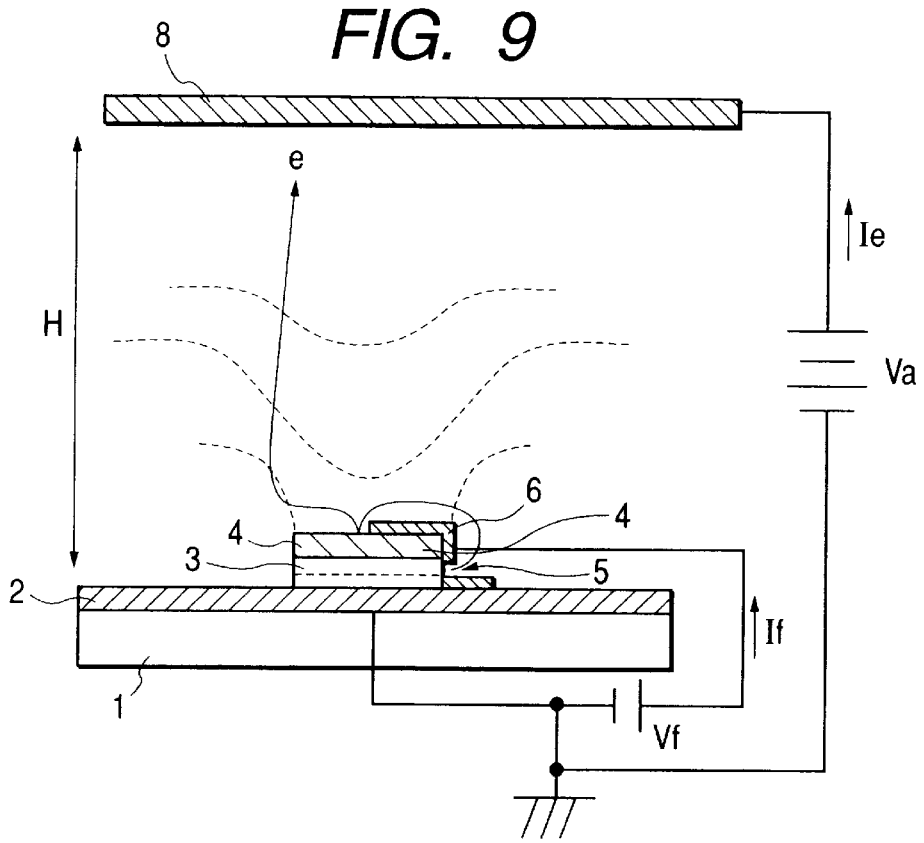
FIG. 9 is a diagram showing a device structure in which steps are formed on both sides of the higher potential electrode and a lower potential electrode.

The device shown in FIG. 9 is of a structure in which a lower-potential side electrode 2, an insulating layer 3 and a higher-potential side electrode 4 are laminated on a substrate. A large difference from the device of the type shown in FIGS. 19A and 19B resides in the electrode structure in which the higher-potential side electrode 4 is sandwiched between the lower-potential side electrode 2 in its cross-sectional view (a cross-sectional view taken along a face perpendicular to a plane of the anode electrode) or a top view (a diagram viewed from the anode electrode 8) (the higher-potential electrode 4 is laminated within an area of the lower-potential electrode 2 so that the lower-electrode 2 exists on both sides thereof.

Hereinafter, the trajectory of electrons emitted from the device will be described.

In the above structure, the number of times of scattering of electrons on the side wall (a surface which is substantially perpendicular to the plane of the anode electrode) is reduced more, the electron trajectory is curved more by a potential produced at an opposite side of the gap 5, and the higher efficiency and the smaller beam shape are obtained as compared with the device shown in FIGS. 19A and 19B.

Figure 10:
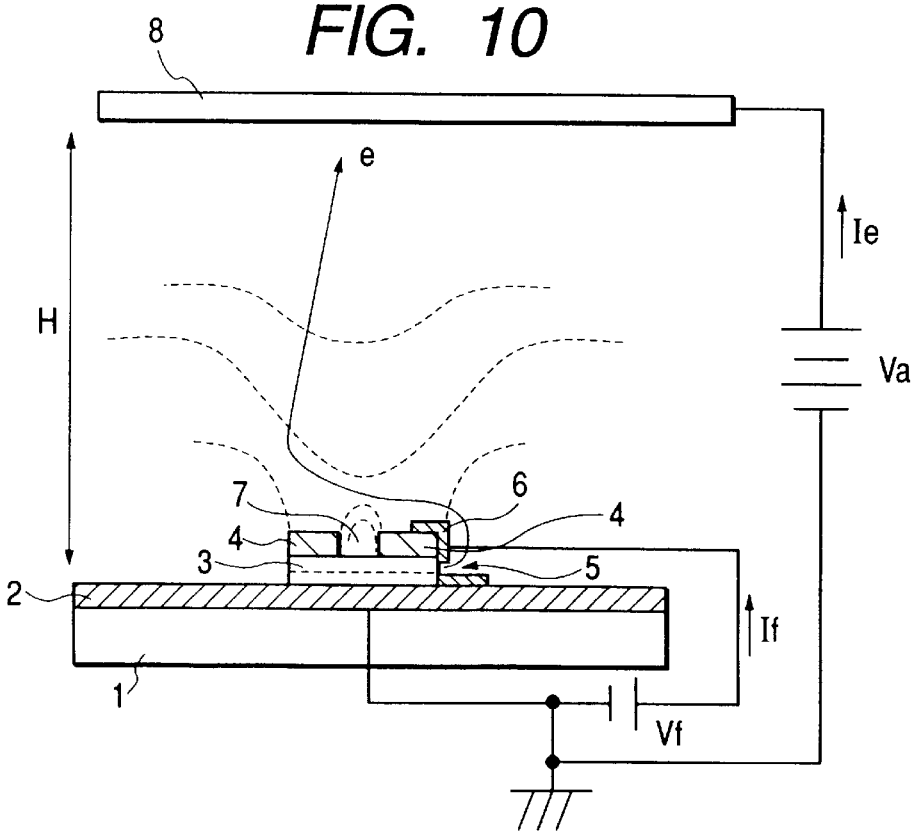
FIG. 10 is a diagram showing an example of the electron emitting device according to the present invention.

In addition, in the device thus structured, if a part of the higher-potential side electrode 4 (higher-potential side electroconductive member) is removed as described above, the number of times of scattering on the "higher-potential side electroconductive member" can be suppressed, thereby being capable of improving the electron emission efficiency as shown in FIG. 10.

Figure 11A:
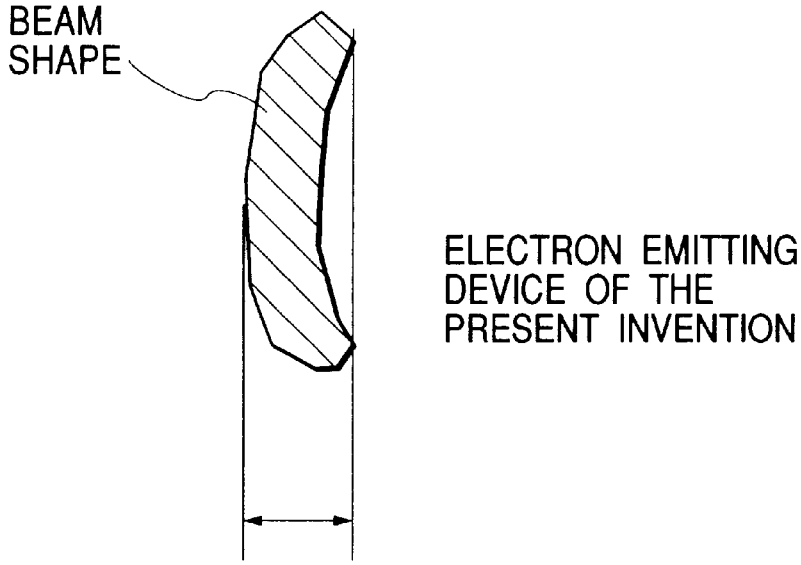
FIGS. 11A and 11B are diagrams showing the shape of a beam from the electron emitting device according to the present invention.
Figure 11B:
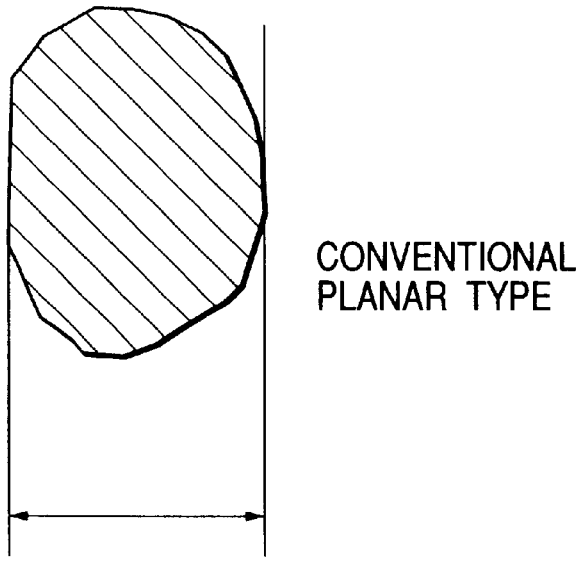

A diagram schematically comparing the beam shape of the electron emitting device of the type shown in FIG. 5 with the beam shape of the conventional planar type electron emitting device shown in FIGS. 18A and 18B is shown in FIGS. 11A and 11B. In the conventional planar type device, a majority of emitted electrons reach the anode electrode on the upper portion of the device after they are scattered on the "higher-potential side electroconductive member" plural number of times.

On the other hand, in the electron emitting device (electron emitting apparatus) according to the present invention, in addition to the structure in which the number of times of scattering can be suppressed, the ununiformity of the electron trajectory due to isotropic scattering can be suppressed as much as possible, as a result of which the beam diameter can be reduced.

Figure 16A:
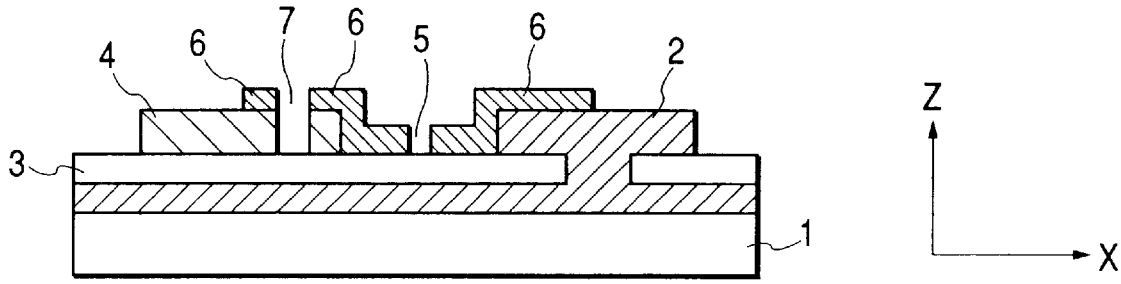
FIGS. 16A and 16B are diagrams showing the planar type structure of an electron emitting device in accordance with a seventh embodiment of the present invention.
Figure 16B:
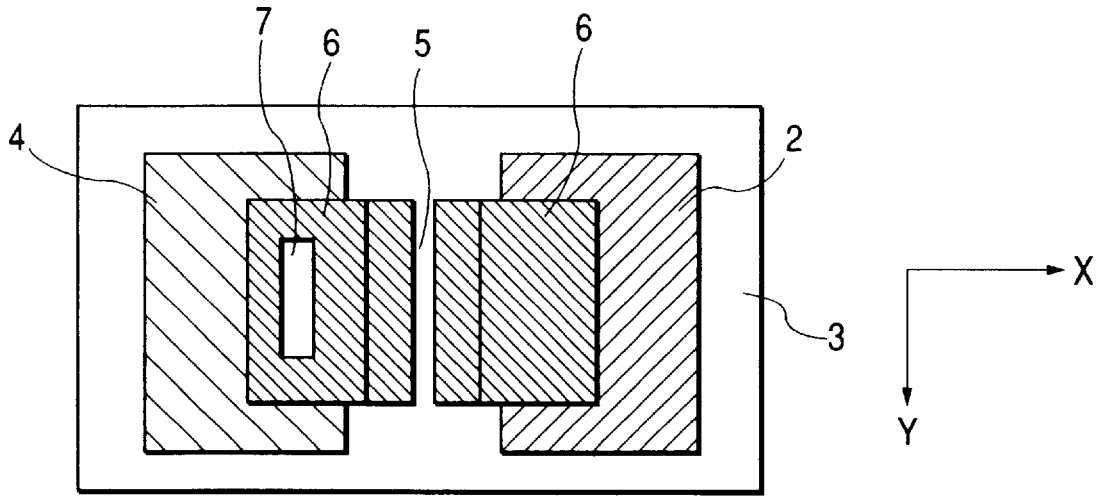

The above description is given of the vertical type device shown in FIGS. 1A and 1B and other figures to which the present invention is applied. However, the present invention can be preferably applied to the lateral-type electron emitting device as shown in FIGS. 16A and 16B. In FIGS. 16A and 16B, the same parts as those in FIGS. 1A and 1B are designated by identical references. In the lateral-type electron emitting device shown in FIGS. 16A and 16B, an opening 7 is defined in the higher-potential side electroconductive member (4, 6), and the potential of the lower-potential electrode 2 under the opening 7 is exuded, thereby being capable of suppressing the scattering on the higher-potential side electroconductive member (4, 6).

Subsequently, a description will be given of an image forming apparatus using the electron emitting device of the present invention.

Figure 12:
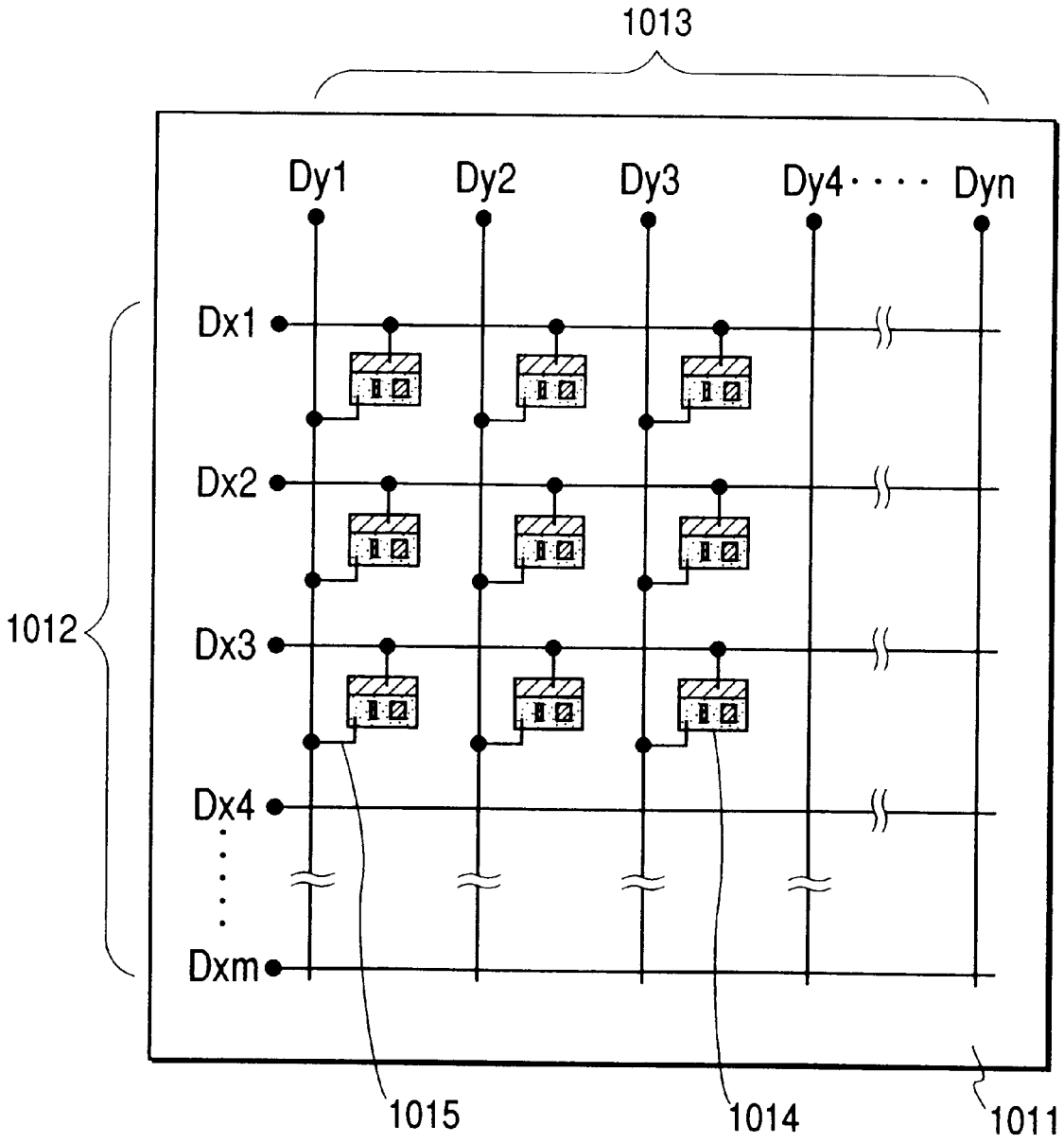
FIG. 12 is a diagram showing an example of a matrix wiring in an image forming apparatus according to the present invention.

An image forming apparatus in which a plurality of electron emitting devices are disposed to which the present invention can be applied will be described with reference to FIGS. 12 and 13. In FIG. 12, reference numeral 1011 denotes an electron source substrate, 1012 is X-directional wirings, and 1013 is Y-directional wirings. Reference numeral 1014 denotes electron emitting devices according to the present invention, and 1015 is connections.

The X-directional wirings 1012 are connected with scanning signal apply means not shown which applies a scanning signal for selecting the rows of the electron emitting devices 1014 of the present invention, On the other hand, the Y-directional wirings 1013 are connected with modulated signal generating means not shown for modulating the respective columns of the electron emitting devices 1014 of the present invention which are arranged in the Y-direction in response to an input signal.

The drive voltage applied to the respective electron emitting device is supplied as a difference voltage between the scanning signal applied to the devices and the modulated signal. In the present invention, the connections are made so that the Y-directional wirings becomes higher in potential whereas the X-directional wirings becomes lower in potential.

The image forming apparatus thus structured by using the electron source arranged in the passive matrix will be described with reference to FIG. 13. FIG. 13 is a diagram showing a display panel of an image forming apparatus using soda lime glass as glass material.

Figure 13:
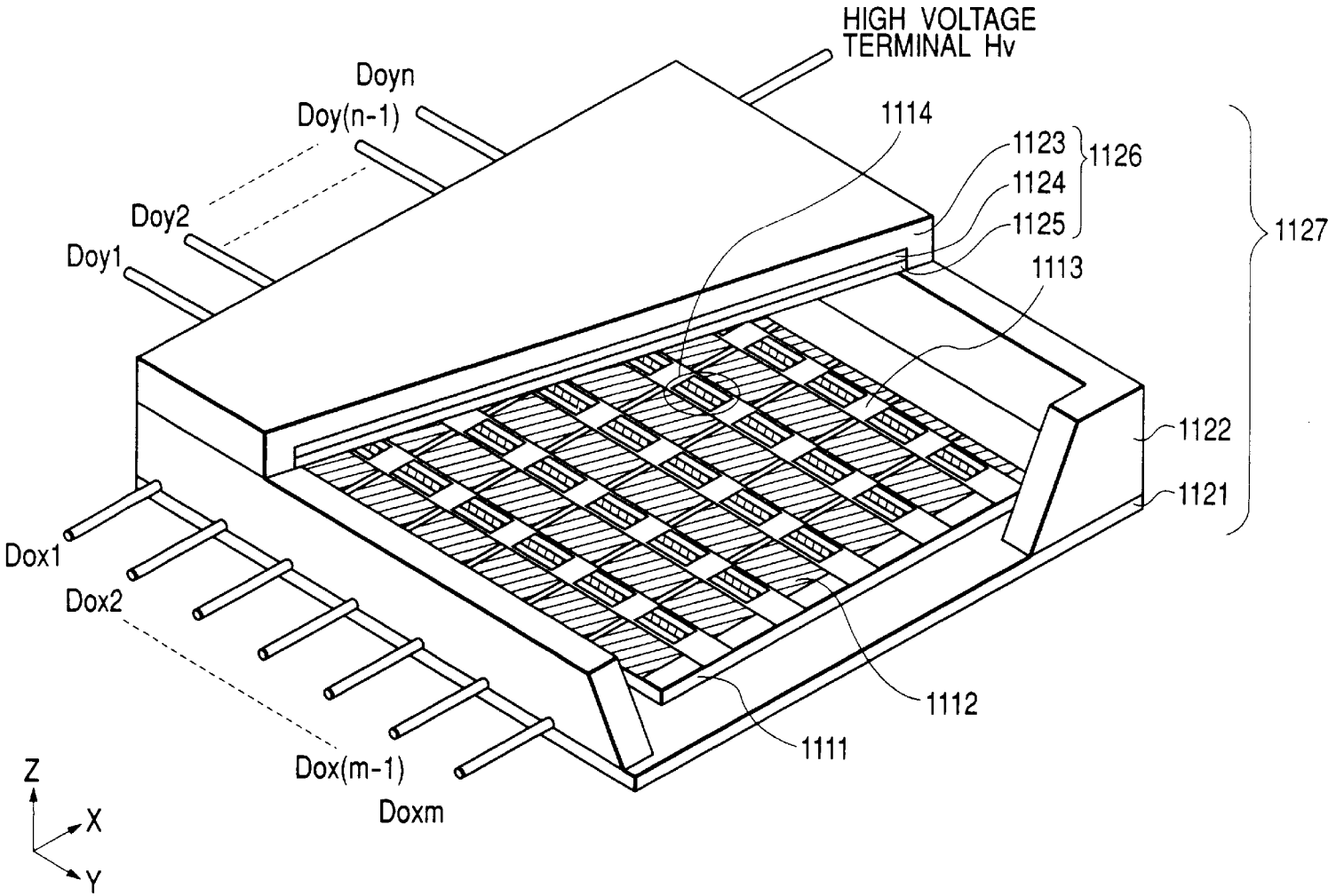
FIG. 13 is a diagram showing an example of the image forming apparatus according to the present invention.

In FIG. 13, reference numeral 1111 denotes; an electron source substrate in which a plurality of electron emitting devices are arranged, 1121 is; a rear plate to which the electron source substrate 1111 is fixed, and 1126 is a face plate where a fluorescent film 1124, a metal back 1125 and so on are formed on an inner surface of the glass substrate 1123.

Reference numeral 1122 denotes a support frame, and the support frame 1122 is connected with a rear plate 1121 and the face plate 1126 through frit glass or the like. Reference numeral 1127 denotes an envelope which is sealed by baking in vacuum at a temperature range of 450° C. for 10 minutes.

Reference numeral 1114 corresponds to the electron emitting region in FIG. 5. Reference numeral 1112 and 1113 denote the X-directional wirings and the Y-directional wirings which are connected with pairs of device electrodes of the electron emitting device of the present invention.

The envelope 1127 is made up of the face plate 1126, the support frame 1122 and the rear plate 1121 as described above. On the other hand, a support member not shown which is called "spacer" is located between the face plate 1126 and the rear plate 1121, to thereby constitute the envelope 1127 having sufficient strength against the atmospheric pressure.

In the image forming apparatus using the electron emitting devices according to the present invention, taking the frajectory of emitted electrons into consideration, phosphors are aligned on the upper portion of the device.

(Embodiments)

Hereinafter, embodiments of the present invention will be described.

(Embodiment 1)

A device manufactured according to a first embodiment will be described with reference to FIGS. 1A, 1B, 2 and 23A to 23E. First, a method of manufacturing the device according to the present invention will be described below.

(Process 1)

Figure 23A:
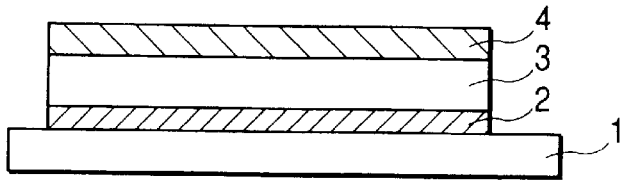
FIGS. 23A, 23B, 23C, 23D and 23E are schematic diagrams showing a process of manufacturing the electron emitting device according to the present invention.

Ta 200 nm in thickness as a device electrode 2, $SiO_2$ 50 nm in thickness as an insulating layer 3 and Ta 50 nm in thickness as a device electrode 4 are deposited on a quartz substrate 1 which has been satisfactorily cleaned through the sputtering method, respectively (FIG. 23A).

(Process 2)

Figure 23B:
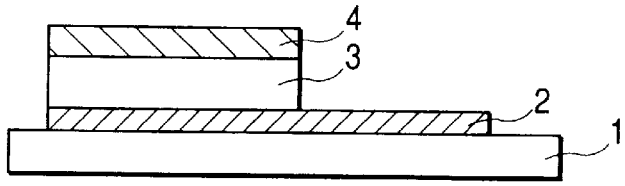

Then, a mask pattern is transferred through the photolithgraphy process. Thereafter, the higher-potential electrode 4 and the insulating layer 3 are dry-etched with a patterned resist as a mask to form a step (FIG. 23B).

(Process 3)

Figure 23C:
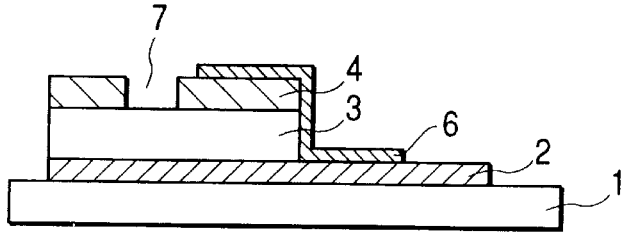

Then, a part of the higher-potential electrode 4 is removed through the photolithgraphy process to form a slit-shaped opening area 7, and an electroconductive film 6 made of Pt-Pd 10 nm in thickness is formed on a step portion composed of the higher-potential side electrode 4 and the insulating layer 3 so that the higher-potential side electrode 4 and the lower-potential side electrode 2 are connected to each other (FIG. 23C). In this situation, as shown in FIGS. 1A and 1B, a width L1 of the opening area 7 is set to 0.5 $\mu$m, a distance L2 from the step is set to 0.5 $\mu$m and a length L4 is set to 30 $\mu$m. Also, a length L3 of the electroconductive film 6 is set to 20 $\mu$m.

(Process 4) (Forming Operation)

Figure 23D:
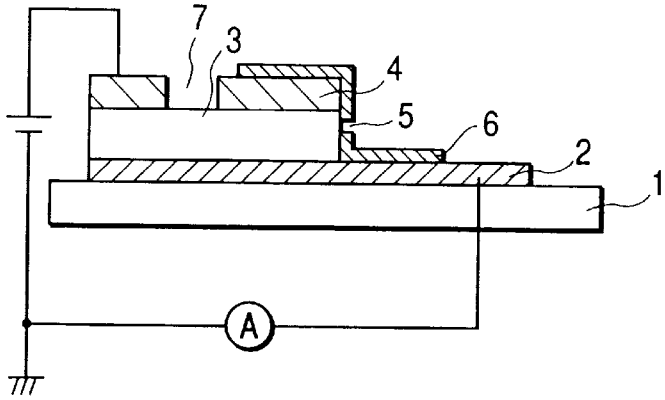

Then, a voltage of 15 V is applied between the electrode 2 and the electrode 4 to define a gap 5 in the electroconductive thin film 6 (FIG. 23D). In this situation, a supply voltage is a pulse voltage and stops at a time when a resistance between the electrodes becomes 10 MΩ.

(Process 5) (Activation Operation)

Figure 23E:
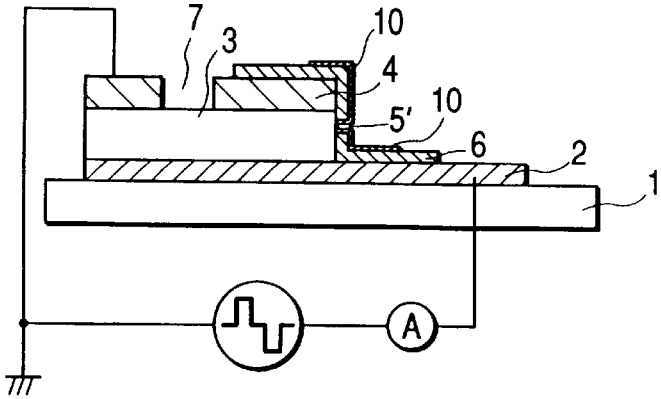

Then, bipolar pulse voltages are applied between the electrodes 2 and 4 under the atmosphere containing benzonitrile (hereinafter referred to as "BN") of $1.3\times10^{-4}$ Pa to form a carbon film 10 on the inner side of the gap 5 and the electroconductive film 6 (FIG. 23E). Through this process, a gap 5' narrower in width is formed on the inner side of the gap 5 formed in the above process 4. The activation operation stops at a time when a current that flows between the electrodes 2 and 4 is saturated.

The device manufactured in the above manner is arranged in the vacuum chamber as shown in FIG. 4 and then driven. The drive voltage is set to Vf=15 V and Va=10 kV, and a distance between the electron emitting device and an anode electrode 44 (an interval between a substrate 1 and the anode electrode 44) H is set to 2 mm. In this example, a phosphor film is coated on the anode electrode, and the spot size of the electron beam is observed. The electron beam size in this example is in a range of 10% or less of the peak luminance of the phosphor that fluoresces.

As a result, the electron beam the beam diameter of which is converged to 100 $\mu$m is obtained, and the electron emission efficiency Ie/If represented by a ratio of the current Ie caused by the electrons that reach the anode electrode on the upper portion of the device to the current If that flows between the higher-potential electrode and the lower-potential electrode of the electron emitting device is superior to that of the device in which no opening area 7 is provided.

The device according to this embodiment obtains the effect of reducing the beam diameter due to the scattering suppression as compared with the conventional device having a structure in which the number of times of scattering is large.

(Embodiment 2)

The device is manufactured in the same shape as that in the first embodiment. In the device according to this embodiment, an insulating layer 3 is obtained by laminating two kinds of layers made of $SiO_2$ and $Al_2O_3$, respectively. The laminating order is made so that the layer of $SiO_2$ is formed on the upper portion of the layer of $Al_2O_3$.

As a result, the potential that is exuded from the above opening area can be stepped up to obtain an excellent electron trajectory.

(Embodiment 3)

Figure 14A:
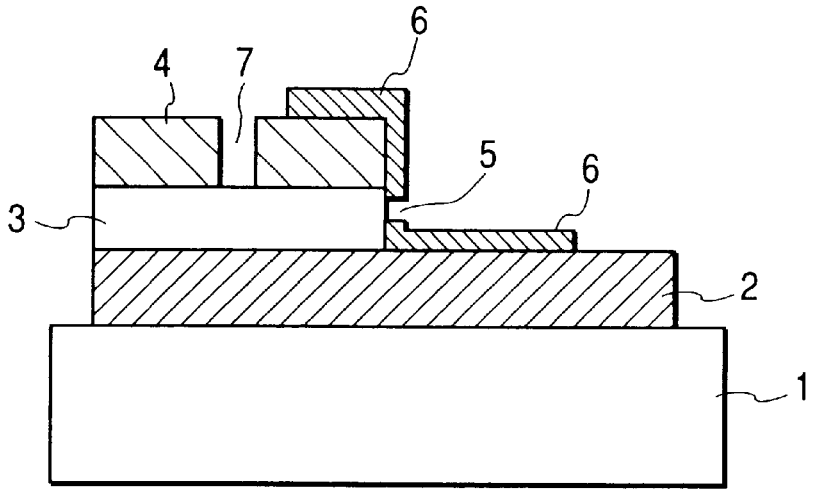
FIGS. 14A and 14B are diagrams showing the structure of an electron emitting device in accordance with a third embodiment of the present invention.
Figure 14B:
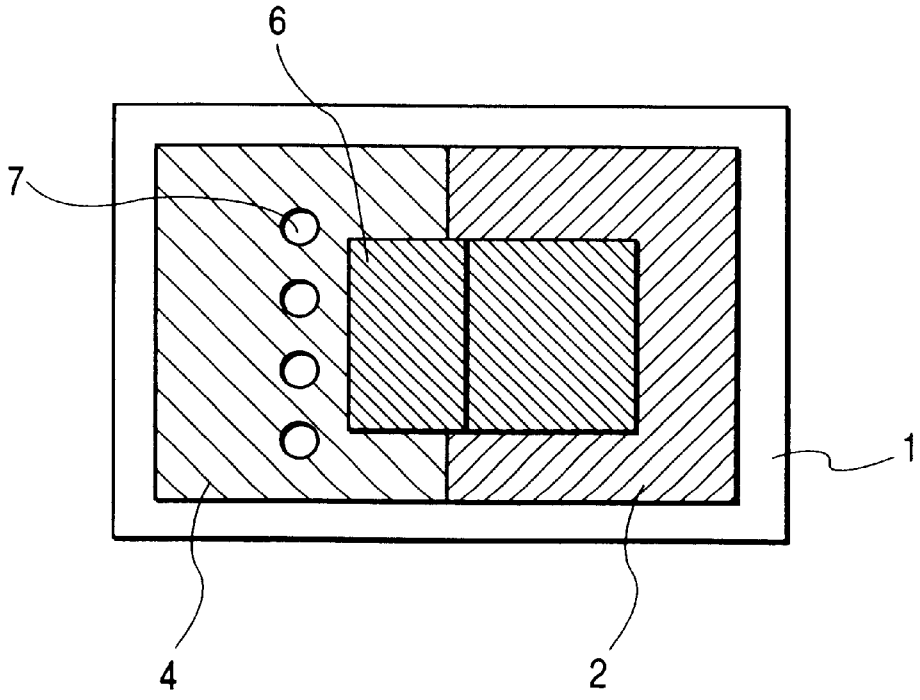
Figure 15A:
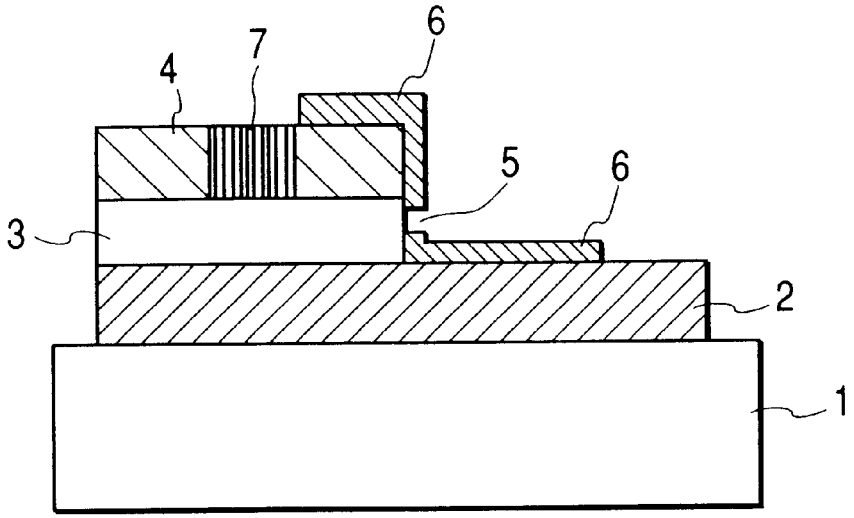
FIGS. 15A and 15B are diagram s showing the structure of an electron emitting device in accordance with a fourth embodiment of the present invention.
Figure 15B:
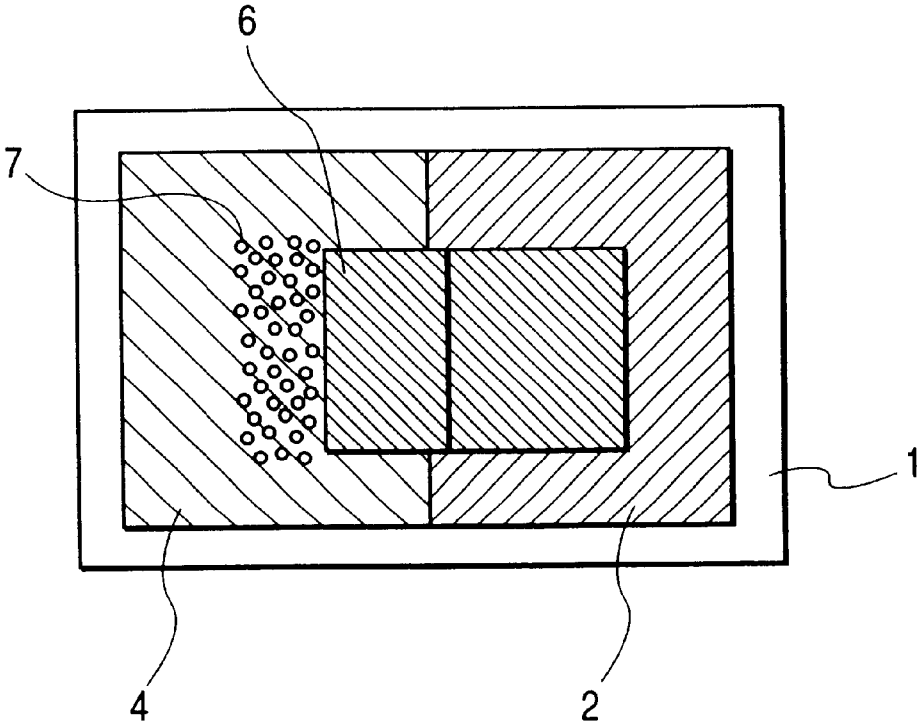

A third embodiment will be described with reference to FIGS. 14A and 14B.

In the device according to this embodiment, only a method of shaping an opening area 7 (process 3) is different from that in the device of the first embodiment. The process 3 conducted in this embodiment will be described below. Other processes are conducted in the same manner as that in the first embodiment.

(Process 3)

A circular pattern 147 which is 0.5 μm in diameter is transferred onto the higher-potential side electrode 4 at a position apart 0.5 μm from the step through the photolithography process, and the higher-potential electrode is removed through the dry etching.

As a result of driving the above device in the same conditions as that in the first embodiment, the excellent electron emission characteristic is obtained as in the first embodiment.

(Embodiment 4)

A fourth embodiment will be described with reference to FIGS. 15A, 15B, 23A and 23B.

(Process 1)

Pt 200 nm in thickness, $SiO_2$ 50 nm in thickness and Ta 50 nm in thickness are deposited on a quartz substrate which has been cleaned, respectively. In addition, Al 300 nm in thickness is deposited on Ta (FIG. 23A).

(Process 2)

After Al is patterned through the photolithography process, a resist is removed. Thereafter, a higher-potential electrode 154 and an insulating layer 153 are dry-etched with Al as a mask to form a step (FIG. 23B).

(Process 3)

Then, aluminum used as the mask is anodized in oxalic acid to form a plurality of opening areas in the Al film. Further, dry etching is conducted through the opening areas of the Al film by using the anodic aluminum oxide as a mask to form opening areas 7 shown in FIGS. 15A and 15B in a higher-potential side electrode 4. After openings 7 are transferred, the anodic aluminum oxide used as the mask is removed by heat phosphoric acid.

(Process 4)

An electroconductive film 6 made of Pt-Pd is formed so as to connect the higher-potential side electrode 4 and a lower-potential side electrode 2 as in the first embodiment, and the forming operation and the activation operation are conducted to form a gap 5.

As a result of measuring the characteristic of the device in this embodiment, the excellent electron emission characteristic is obtained as in the first embodiment.

(Embodiment 5)

A fifth embodiment will be described with reference to FIG. 10.

(Process 1)

A lower-potential side electrode 2, an insulating layer 3 and a higher-potential side electrode 4 are laminated on a substrate as in the first embodiment, and a step structure is formed through the photolithgraphy process. In this embodiment, two steps constructed of the higher-potential electrode 4 and the insulating layer 3 exist, and the width of the higher-potential side electrode is set to 4 μm.

(Process 2)

Then, a part of the higher-potential side electrode 4 is removed through the photolithgraphy process to form a slit-shaped opening area 7 as in the first embodiment. The slit position is designed such that L2 is set to 0.5 μm and the width L1 is set to 0.5 μm.

(Process 3)

An electroconductive film 6 made of Pt-Pd is deposited in the same manner as that in the first embodiment. In this embodiment, Pt-Pd is selectively deposited on only one of the two steps. Sequentially, the forming operation and the activation operation are conducted as in the first embodiment to form a gap 5.

As a result of the above, the excellent electron emission efficiency and electron trajectory are obtained.

(Embodiment 6)

An image forming apparatus is manufactured by using the electron emitting devices fabricated in the first to fourth embodiments. As an example, a case using the devices fabricated in the first embodiment will be described.

The electron emitting devices according to the first embodiment are disposed in a matrix of 10×10, and X-directional wirings are connected to a higher-potential side electrode, and Y-directional wirings are connected to a lower-potential side electrode. A phosphor is disposed above the device at a distance of 2 mm.

As a result of setting the drive conditions to Va=10 kV and Vf=15 V, a high-precision image display can be made.

(Embodiment 7)

The device manufactured in this embodiment is described with reference to FIGS. 16A and 16B. This embodiment ia an example in which the present invention is applied to a planar type device.

(Process)

Al is deposited as a lower-potential side electrode 2 on a quartz substrate through the sputtering method, and $SiO_2$ is deposited on the Al through the sputtering method.

(Process 2)

Then, a higher-potential side electrode 4 and the lower-potential side electrode 2 are formed on $SiO_2$ by a Pt electrode. The lower-potential side electrode 2 is electrically connected to the Al film through a contact hole defined in an insulating layer 3.

(Process 3)

Then, a slit-shaped opening area 7 which is 1 μm in width is formed in an area apart from a gap 5 by 0.5 μm.

In the planar type device manufactured through the above method, the electron scattering on the higher-potential side electrode 4 is suppressed, and the electron emission efficiency is improved as compared with the conventional planar type device.

(Embodiment 8)

Figure 17A:
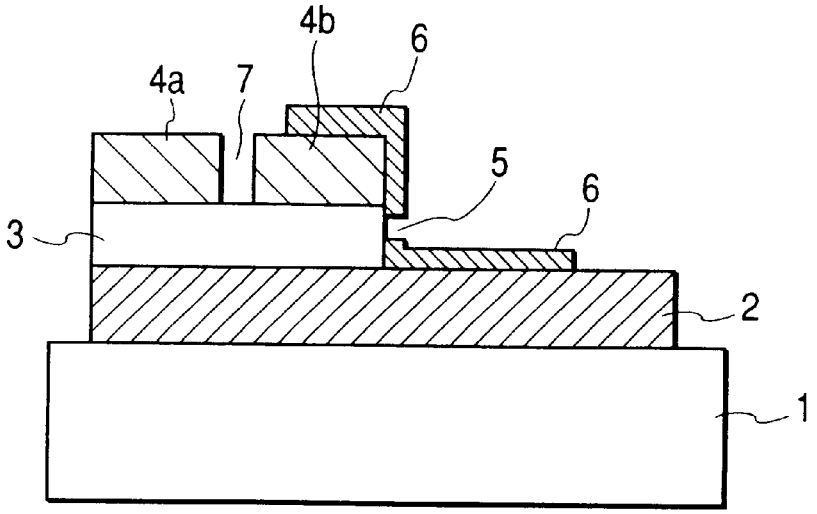
FIGS. 17A and 17B are diagrams showing the structure of an electron emitting device in accordance with an eighth embodiment of the present invention.
Figure 17B:
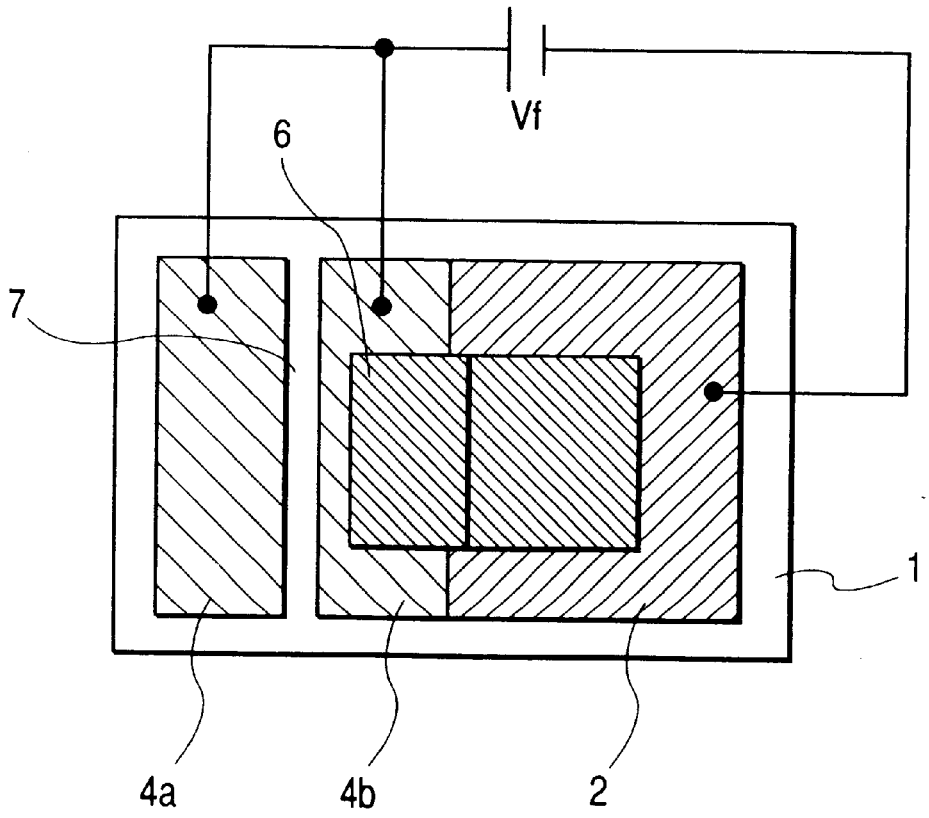

An eighth embodiment will be described with reference to FIGS. 17A and 17B.

The electron emitting device is manufactured in the same manner as that of the first embodiment. The structure manufactured in this embodiment is such that a higher-potential side electrode 4 is perfectly separated into two electrodes (4*a*, 4*b*). These higher-potential side electrodes 4*a* and 4*b* are connected to the same potential through an external circuit. Similarly, in this structure, the excellent electron emission characteristic is obtained.

Also, this embodiment shows the structure in which the higher-potential side electrode is perfectly separated into the two electrodes. However, this same effect is obtained even if the higher-potential side electrode is separated into three or more electrodes.

As was described above, according to the present invention, the number of times of scattering the electrons on the higher-potential side electrode is reduced by utilizing the exudation of the potential from the lower-potential side electrode, thereby being capable of preventing a deterioration of the efficiency due to the multiplex scattering and improving the electron emission efficiency.

Also, since the number of times of scattering can be suppressed, the ununiformity of the electron trajectory due to the isotropic scattering can be suppressed as much as possible. Thus, the convergence of the electron trajectory can be realized.

Further, since the improvement in the electron emission efficiency of the electron emitting device is realized, the electron source and the image forming apparatus which are excellent in performance can be provided. Further, the image forming apparatus high in precision and high in grade can be realized.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An electron emitting apparatus, comprising:

(A) a substrate having a first primary surface which is substantially plane;

(B) an electron emitting device disposed on said first primary surface, comprising a first electroconductive member and a second electroconductive member, wherein a gap is formed between said first electroconductive member and said second electroconductive member;

(C) an anode electrode having a substantially plane surface opposite to said first primary surface;

(D) voltage applying means for applying a potential higher than a potential applied to said first electroconductive member to said second electroconductive member in order to emit electrons from said electron emitting device; and (E) voltage applying means for applying a potential higher than the potential applied to said second electroconductive member in order to irradiate the electrons emitted from said electron emitting device onto said anode electrode;

wherein a through-hole that penetrates said second electroconductive member is defined in a part of said second electroconductive member which exists within a range from the gap to a distance Xs represented by the following expression (1), an electroconductive member to which a potential lower than said second electroconductive member is applied is disposed under said through-hole; and $$Xs=H\times Vf/(\pi\times Va) \quad (1)$$

where H is a distance between a plane of said anode electrode and said first primary surface, Vf is a voltage applied between said first electroconductive member and said second electroconductive member, Va is a voltage applied between said anode electrode and said first electroconductive member, and $\pi$ is the ratio of the circumference of a circle to its diameter.

2. The electron emitting apparatus according to claim 1, wherein a range from said gap to the distance Xs is a range on a line segment extending from said gap toward said second electroconductive member along the surface of said second electroconductive member by said distance Xs.

3. The electron emitting apparatus according to claim 2, wherein the line segment extending along the surface of said second electroconductive member by said distance Xs is a line segment extending from said gap toward said second electroconductive member in a direction along which said first electroconductive member and said second electroconductive member face each other.

4. The electron emitting apparatus according to claim 3, wherein the line segment extending along the surface of said second electroconductive member by said distance Xs is substantially a straight line when said electron emitting device is viewed from said anode electrode.

5. The electron emitting apparatus according to claim 1, wherein said first electroconductive member and said second electroconductive member are laminated on each other through an insulating layer, and an electroconductive member to which a potential lower than that of said second electroconductive member is applied under said through-hole is said first electroconductive member.

6. The electron emitting apparatus according to claim 5, wherein the laminating direction of said first electroconductive member and said second electroconductive member is substantially perpendicular to said first primary surface.

7. The electron emitting apparatus according to claim 5, wherein said insulating layer are made of at least two kinds of insulating materials different in dielectric constant.

8. The electron emitting apparatus according to claim 1, wherein said first electroconductive member and said second electroconductive member are disposed on said first primary surface.

9. The electron emitting apparatus according to claim 1, wherein a plurality of said through-holes are provided.

10. The electron emitting apparatus according to claim 1, wherein said through-hole penetrates from said second electroconductive member to the electroconductive member to which a potential lower than that of said second electroconductive member disposed under said through-hole.

11. The electron emitting apparatus according to claim 1, wherein a plurality of said electron emitting devices are disposed on said first primary surface.

12. The electron emitting apparatus according to claim 11, wherein said electron emitting devices are wired in a matrix.

13. The electron emitting apparatus according to claim 1, wherein an image forming apparatus that forms an image by the electrons emitted from said electron emitting device is disposed on said anode electrode.

14. The electron emitting apparatus according to claim 13, wherein said image forming member comprises a phosphor.

* * * * *

UNITED STATES PATENT AND TRADEMARK OFFICE

CERTIFICATE OF CORRECTION

PATENT NO. : 6,583,553 B2
DATED : June 24, 2003
INVENTOR(S) : Daisuke Sasaguri

It is certified that error appears in the above-identified patent and that said Letters Patent is hereby corrected as shown below:

Title page,
Item [56], References Cited, OTHER PUBLICATIONS, "SID 98 Digest; M. Okuda et al.; Electron Trajectory Analysis of Surface Conduction Electron Emitter Displays (SEDs) 1998; pp.185-188." should be deleted.

Column 11,
Line 6, "Least" should read -- least --.

Column 13,
Line 21, "denotes;" should read -- denotes --.

Signed and Sealed this

Twenty-third Day of March, 2004

JON W. DUDAS
*Acting Director of the United States Patent and Trademark Office*